US006940484B2

(12) United States Patent
Yatabe

(10) Patent No.: US 6,940,484 B2
(45) **Date of Patent: *Sep. 6, 2005**

(54) SYSTEMS AND METHODS FOR DRIVING A DISPLAY DEVICE

(75) Inventor: Satoshi Yatabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 727 days.

This patent is subject to a terminal disclaimer.

(21) Appl. No.: 09/906,643

(22) Filed: Jul. 18, 2001

(65) Prior Publication Data

US 2002/0015030 A1 Feb. 7, 2002

(30) Foreign Application Priority Data

Jul. 21, 2000 (JP) ..... 2000-220836

(51) Int. Cl.[7] ..... G09G 3/36
(52) U.S. Cl. ..... 345/99; 87/96
(58) Field of Search ..... 345/87, 94, 96, 345/98–100, 102, 204, 208, 209, 212, 213, 97, 92, 211, 214, 90, 694, 695, 89, 95, 103

(56) References Cited

U.S. PATENT DOCUMENTS 3,883,778 A * 5/1975 Kaji et al. ..... 315/205
5,379,050 A * 1/1995 Annis et al. ..... 345/94
6,040,814 A * 3/2000 Murakami et al. ..... 345/94
6,407,727 B1 * 6/2002 Plangger ..... 345/87
6,636,206 B1 * 10/2003 Yatabe ..... 345/204

FOREIGN PATENT DOCUMENTS

JP WO 98/08133 2/1998
JP WO 01/39165 A1 5/2001

* cited by examiner

*Primary Examiner*—Amare Mengistu
*Assistant Examiner*—Tom Sheng
(74) *Attorney, Agent, or Firm*—Oliff & Berridge, PLC

(57) ABSTRACT

This invention provides a system for driving a display device that uses only a longitudinally elongated region in a display screen as a display region, and limits the power consumption to a lower level. When a pixel belonging to a specific data line in a plurality of data lines is put into a display state, and pixels belonging to other data lines are put into a non-display state, one scanning line in a plurality of scanning lines is selected every one horizontal scanning time period, a selection voltage is applied to the selected scanning line in the second half time period of one of time periods, into which the one horizontal scanning time period is divided, and the polarity of the selection voltage is reversed at least every two or more horizontal scanning time periods on the basis of an intermediate value of a voltage applied to the data lines, while a non-lighting voltage is supplied to data lines other than the specific data line according to the polarity of the selection voltage applied to the selected scanning line, and by reversing the polarity every two or more horizontal scanning time periods corresponding to a polarity reversal period of the selection voltage.

9 Claims, 26 Drawing Sheets

<1/2H SELECTION, 2H REVERSAL>

<1/2H SELECTION, 4H REVERSAL>

<1/2H SELECTION, 4H REVERSAL, FRONT AND REAR ENDS>

<4-VALUED DRIVING (1H SELECTION, 1H REVERSAL)>

<4-VALUED DRIVING (1H SELECTION, 1H REVERSAL)>

SYSTEMS AND METHODS FOR DRIVING A DISPLAY DEVICE

BACKGROUND OF THE INVENTION

1. Field of Invention

The present invention relates to a method for driving a display device that reduces the power consumption by placing only a pixel belonging to a specific data line into a display state, while placing pixels belonging to other data lines into a non-display state.

2. Description of Related Art

In display devices used in portable electronic apparatus, such as portable telephones, the number of display dots has rapidly increased so that more information can be displayed. On the other hand, since portable electronic apparatuses are battery driven in principle, there exists a strong desire to reduce their power consumption. For this reason, the display device used in the portable electronic apparatus is required to have two apparently contradictory features of high resolution and low power consumption.

Thus, in order to solve such a problem, the following driving method called a partial display driving (also referred to as a partial driving) has been proposed. That is, in the partial display driving, when a full-screen display operation is not particularly required, such as during standby, scanning signals are supplied only to a part of scanning lines, whereby only a region of pixels belonging to the part of the scanning lines is put into a display state, while other regions of pixels are put into a non-display state, as shown in FIG. 26 to suppress the power consumption.

According to the partial display driving, however, a display region (non-display region) is necessarily long sideways in accordance with a direction of formation of scanning lines, so that a display mode in the partial display is restricted in this sense. Nevertheless, when a display operation is performed in which a display region is long lengthways, with a configuration in which a non-lighting voltage is simply supplied to data lines included in a non-display region, a switching frequency of the voltage applied to the data lines is not decreased, so that the power consumption is not effectively reduced.

SUMMARY OF THE INVENTION

The present invention is made in view of the above circumstances, and an object is to provide a method for driving a display device in which a display region is long lengthways, and which can suppress the power consumption, a driving circuit therefor, a display device and an electronic apparatus.

To achieve the above object, in accordance with a first aspect of the present invention, there is provided a method for driving a display device driving a pixel provided corresponding to each of intersections between a plurality of scanning lines and a plurality of data lines, wherein one scanning line in the plurality of scanning lines is selected every one horizontal scanning time period. Further, a selection voltage is applied to the selected scanning line in one of time periods, into which the one horizontal scanning time period is divided. The polarity of the selection voltage is reversed at least every two or more horizontal scanning time periods on the basis of an intermediate value of a lighting voltage and a non-lighting voltage applied to the data lines. When a pixel belonging to a specific data line in the plurality of data lines is put into a display state, and pixels belonging to other data lines are put into a non-display state, a lighting voltage is applied to the specific data line in one horizontal scanning time period, in which one scanning line in the plurality of scanning lines is selected and a selection voltage is applied to the selected scanning line, according to the contents to be displayed by a pixel corresponding to an intersection between the selected scanning line and the specific data line, and a lighting voltage and a non-lighting voltage are applied to the specific data line for substantially the same period over one horizontal scanning time period in which the selected scanning line is selected, while a non-lighting voltage is supplied to data lines other than the specific data line according to the polarity of the selection voltage applied to the selected scanning line, and by reversing the polarity every polarity reversal period of the selection voltage.

According to this driving method, the selection voltage is applied to each of the scanning lines in one of time periods, into which the one horizontal scanning time period is divided. Here, since the lighting voltage and the non-lighting voltage are applied to the data line in the display state (specific data line) for substantially the same period in the one horizontal scanning time period, occurrence of crosstalk depending on a display pattern is prevented. On the other hand, the non-lighting voltage is applied to data lines in the non-display state (data lines other than the specific data line) for the one horizontal scanning time period, in which the scanning line is selected. In this case, since the polarity of the selection voltage applied to the scanning line is reversed every two or more scanning time periods, the non-lighting voltage applied to the data lines in the non-display state is switched every two or more horizontal scanning time periods. For this reason, a switching frequency of the voltage applied to the data lines of the pixel, which should be put into the non-display state, is decreased, so that the power consumed in accordance with the switching can be suppressed.

Incidentally, the lighting voltage in the present case means, when an attention is paid to a certain one horizontal scanning line, a voltage of a data signal having the polarity opposite to that of the selection voltage applied in one of the time periods, and the non-lighting voltage means, when an attention is paid to a certain one horizontal scanning line, a voltage of a data signal having the same polarity as the selection voltage applied in one of the time periods. Therefore, even if the positive-side voltage is applied to the data line, when the selection voltage has the negative-side polarity, the voltage is the lighting voltage, and conversely, the voltage is the non-lighting voltage when the selection voltage has the positive-side polarity.

Here, in the first aspect of the invention, it is preferable that, when a scanning line is selected, a selection voltage is applied to the selected scanning line in the second half time period of one of time periods, into which one horizontal scanning time period is divided. When the next one scanning line is selected, a selection voltage is applied to the selected scanning line in the first half time period of one of time periods, into which one horizontal scanning time period is divided. The selection voltage is alternately applied in one time period and in the other time period every one horizontal scanning time period. If the selection voltage is alternately applied in one time period and in the other time period every one horizontal scanning time period in this way, in a case where ON-displayed or OFF-displayed pixels belonging to the specific data line continue, the switching frequency of the voltage applied to the data line is decreased, so that the power consumption can be further suppressed.

Further, in the first aspect of the invention, a method is preferable in which, when the selection voltage is applied in the second half time period, a lighting voltage is applied to the specific data line from a point of time before an end point of the second half time by a time period according to the gray scale of a pixel corresponding to an intersection between the selected scanning line and the specific data line to the end point of the second half time period, and a non-lighting voltage is applied in the remaining time period of the second half time period. While, when the selection voltage is applied in the first half time period, a lighting voltage is applied to the specific data line from a starting point of the first half time period to a time period according to the gray scale of a pixel corresponding to an intersection between the selected scanning line and the specific data line, and a non-lighting voltage is applied in the remaining time period of the first half time period. According to this method, a gray scale display is performed by a so-called rightward modulation method on a pixel corresponding to an intersection between an scanning line and the specific data line, while the gray scale display is performed by a so-called leftward modulation method on a pixel corresponding to an intersection between the next one scanning line and the specific data line. Even in the case where an intermediate gray scale display is performed on a pixel located on the specific data line, this decreases the switching frequency between the lighting voltage and the non-lighting voltage, so that the power consumed in accordance with the switching can be further suppressed.

Similarly, in order to achieve the above object, in accordance with a second aspect of the present invention, there is provided a driving circuit for a display device driving a pixel provided corresponding to each of intersections between a plurality of scanning lines and a plurality of data lines. The driving circuit includes a scanning line driving circuit for selecting one scanning line in the plurality of scanning lines every one horizontal scanning time period, applying a selection voltage to the selected scanning line in one of time periods, into which the one horizontal scanning time period is divided, and reversing the polarity of said selection voltage at least every two or more horizontal scanning time periods on the basis of an intermediate value of a lighting voltage and a non-lighting voltage applied to the data lines. The driving circuit further includes a data line driving circuit for applying, when a pixel belonging to a specific data line in the plurality of data lines is put into a display state, and pixels belonging to other data lines are put into a non-display state, a lighting voltage to the specific data line in one horizontal scanning time period, in which one scanning line in the plurality of scanning lines is selected and a selection voltage is applied to the selected scanning line, according to the contents to be displayed by a pixel corresponding to an intersection between the selected scanning line and the specific data line, and applying a lighting voltage and a non-lighting voltage to said specific data line for substantially the same period over one horizontal scanning time period, in which the selected scanning line is selected, while supplying a non-lighting voltage to data lines other than the specific data line according to the polarity of the selection voltage applied to the selected scanning line, and by reversing the polarity every polarity reversal period of the selection voltage. With this configuration, in a manner similar to that of the above first aspect of the invention, occurrence of crosstalk depending on a display pattern is prevented, while the non-lighting voltage applied to the data lines included in the non-display state is switched every two or more horizontal scanning time periods, so that the power consumed in accordance with the switching can be suppressed.

In the second aspect of the invention, a configuration is preferable in which the scanning line driving circuit applies a selection voltage to the selected scanning line in the second half time period of one of time periods, into which one horizontal scanning time period is divided, when a scanning line is selected. The driving circuit further applies a selection voltage to the selected scanning line in the first half time period of one of time periods, into which one horizontal scanning time period is divided, when the next one scanning line is selected and applies the selection voltage alternately in one time period and in the other time period every one horizontal scanning time period. With this configuration, in a case where white-displayed or black-displayed pixels belonging to the specific data line continue, the switching frequency of the voltage applied to the data line is decreased, so that the power consumption can be suppressed.

Further, in the second aspect of the invention, a configuration is preferable in which, when said selection voltage is applied in the second half time period by the scanning line driving circuit, the data line driving circuit applies a lighting voltage to the specific data line from a point of time before an end point of the second half time by a time period according to the gray scale of a pixel corresponding to an intersection between the selected scanning line and the specific data line to the end point of the second half time period, and applies a non-lighting voltage in the remaining time period of the second half time period. While, when said selection voltage is applied in the first half time period by the scanning line driving circuit, the data line driving circuit applies a lighting voltage to the specific data line from a starting point of the first half time period to a time period according to the gray scale of a pixel corresponding to an intersection between the selected scanning line and the specific data line, and applies a non-lighting voltage in the remaining time period of the first half time period. With this configuration, even in the case where an intermediate gray scale display is performed on a pixel located on the specific data line, the switching frequency between the lighting voltage and the non-lighting voltage is decreased, so that the power consumed in accordance with the switching can be further suppressed.

Similarly, in order to achieve the above object, in accordance with a third aspect of the present invention, there is provided a display device having a pixel provided corresponding to each of intersections between a plurality of scanning lines and a plurality of data lines. The display device including a scanning line driving circuit for selecting one scanning line in the plurality of scanning lines every one horizontal scanning time period, applying a selection voltage to the selected scanning line in one of time periods into which the one horizontal scanning time period is divided, and reversing the polarity of the selection voltage at least every two or more horizontal scanning time periods on the basis of an intermediate value of a lighting voltage and a non-lighting voltage applied to the data lines. The display device further including a data line driving circuit for applying, when a pixel belonging to a specific data line in the plurality of data lines is put into a display state, and pixels belonging to other data lines are put into a non-display state, a lighting voltage to the specific data line in one horizontal scanning time period, in which one scanning line in the plurality of scanning lines is selected and a selection voltage is applied to the selected scanning line, according to the contents to be displayed by a pixel corresponding to an intersection between the selected scanning line and the specific data line, and applying a lighting voltage and a non-lighting voltage to the specific data line for substantially the same period over one horizontal scanning time period, in which the selected scanning line is selected, while supplying a non-lighting voltage to date lines other than the specific data line according to the polarity of the selection voltage applied to the selected scanning line, and by reversing the polarity every polarity reversal period of the selection voltage. With this configuration, in a manner similar to that of the above first and second aspects of the invention, occurrence of crosstalk depending on a display pattern is prevented, while the non-lighting voltage applied to the data lines in the non-display state is switched every two or more horizontal scanning time periods, so that the power consumed in accordance with the switching can be suppressed.

Here, in the third aspect of the invention, a configuration is preferable in which the pixel includes a capacitive device consisting of a switching device and an electro-optical material, and when a selection voltage is applied to one scanning line, a switching device of the pixel belonging to the scanning line is put into a conductive state, and writing operation according to a lighting voltage applied to the corresponding data line is performed on the capacitive device corresponding to the switching device. With this configuration, a selection pixel and a non-selection pixel are electrically separated, so that excellent contrast and response are provided, and high-definition display can be performed.

It is preferable that the switching device is a two-terminal switching device, and the pixel is constructed by series-connecting the two-terminal switching device and the capacitive device between a scanning line and a data line. In the third aspect of the invention, while a three-terminal switching device, such as a transistor, may be used as the switching device, it is necessary to form the scanning lines and the data lines so as to intersect one another on one of the substrates, so that there is a defect in that the likelihood of occurrence of a short circuit in the wiring is enhanced, and the manufacturing process is complicated. In contrast, the two-terminal switching device has an advantage in that no short circuit is caused in the wiring in principle.

Further, it is preferable that the two-terminal switching device has a conductor/insulator/conductor structure connected to the scanning line or the data line. One of the conductors can be used as the scanning line or the data line without any change, and the insulator can be formed by anodizing the conductor, so that the manufacturing process is simplified.

Additionally, in order to achieve the above object, in accordance with a fourth aspect of the invention of the present case, there is provided an electronic apparatus comprising the display device. Therefore, as described above, this electronic apparatus can prevent the occurrence of crosstalk and reduces the power consumption.

DETAILED DESCRIPTION OF PREFERRED EMBODIMENTS

Figure 1:
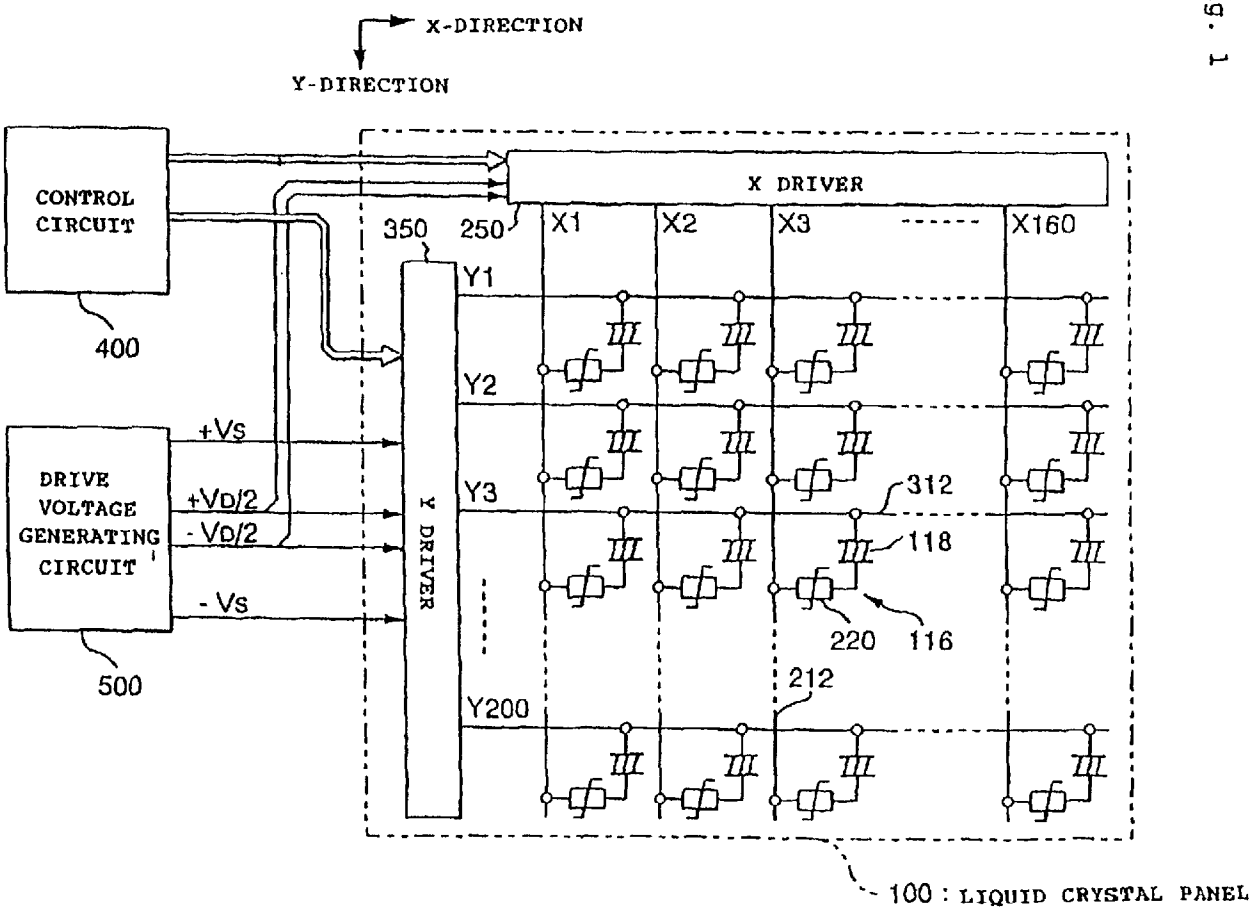
FIG. 1 is an exemplary block diagram showing the electrical configuration of a display device according to a first embodiment of the present invention.

First, the electrical configuration of a display apparatus according to a first embodiment of the present invention will be described. FIG. 1 is a block diagram showing the electrical configuration of this display device. As shown in this figure, a liquid crystal panel 100 has a plurality of data lines (segment electrodes) 212 formed in such a manner as to extend in a column (Y) direction, while a plurality of scanning lines (common electrodes) 312 formed in such a manner as to extend in a line (X) direction, and a pixel 116 formed corresponding to each of intersections between the data lines 212 and the scanning lines 312. Further, each pixel 116 consists of a serial connection of a liquid crystal layer 118 and a TFD (Thin Film Diode) 220, which is one example of a switching device. As will be described later, the liquid crystal layer 118 has a configuration such that liquid crystal, which is an example of electro-optical materials, is sandwiched between the scanning lines 312 serving as counter electrodes and the pixel electrodes. Incidentally, for convenience of description, in this embodiment, it is assumed that the total number of the scanning lines 312 is 200, and that the total number of the data lines 212 is 160, and this embodiment is described as a 200×160 matrix type display device. However, it is to be understood that the present invention is not limited to a 200×160 matrix type display, and that other configurations may be used without departing from the spirit and scope of the present invention.

Next, a Y driver 350, generally called a scanning line driving circuit, supplies scanning signals Y1, Y2, . . . , Y200 to the corresponding scanning lines 312. More specifically, the Y driver 350 according to this embodiment sequentially selects one scanning line 312 every one horizontal scanning time period, and a selection voltage is applied in a second half time period in the selection time period, and a non-selection voltage (holding voltage) is applied in a first half time period and a non-selected time period (holding time period) of the selection time period.

In addition, an X driver 250, generally called a data line driving circuit, supplies data line signals X1, X2, . . . , X160 to a pixel 116, which is located on the scanning line 312 selected by the Y driver 350 via a corresponding data line 212 in accordance with display contents. Incidentally, detailed configurations of the X driver 250 and the Y driver 350 will also be described in greater detail later.

On the other hand, a control circuit 400 supplies various control signals and clock signals, which will be described in greater detail later, to the X driver 250 and the Y driver 350 so as to control both of the drivers. In addition, a driving voltage generating circuit 500 generates data signals, the voltage $\pm V_D/2$, which is also used as a non-selection voltage in the scanning signals, and the voltage $\pm V_S$, which is used as a selection voltage in the scanning signals, respectively.

Incidentally, in this embodiment, the polarity of the voltage supplied to the scanning lines 312 or the data lines 212 is determined on the basis of a value of an intermediate electric potential of the voltage $\pm V_D/2$ applied to the data lines 212: when the electric potential to be applied is higher than the intermediate value, the electric potential is determined as being on the positive-side; when the electric potential to be applied is lower than the intermediate value, this electric potential is determined as being on the negative-side.

Figure 2:
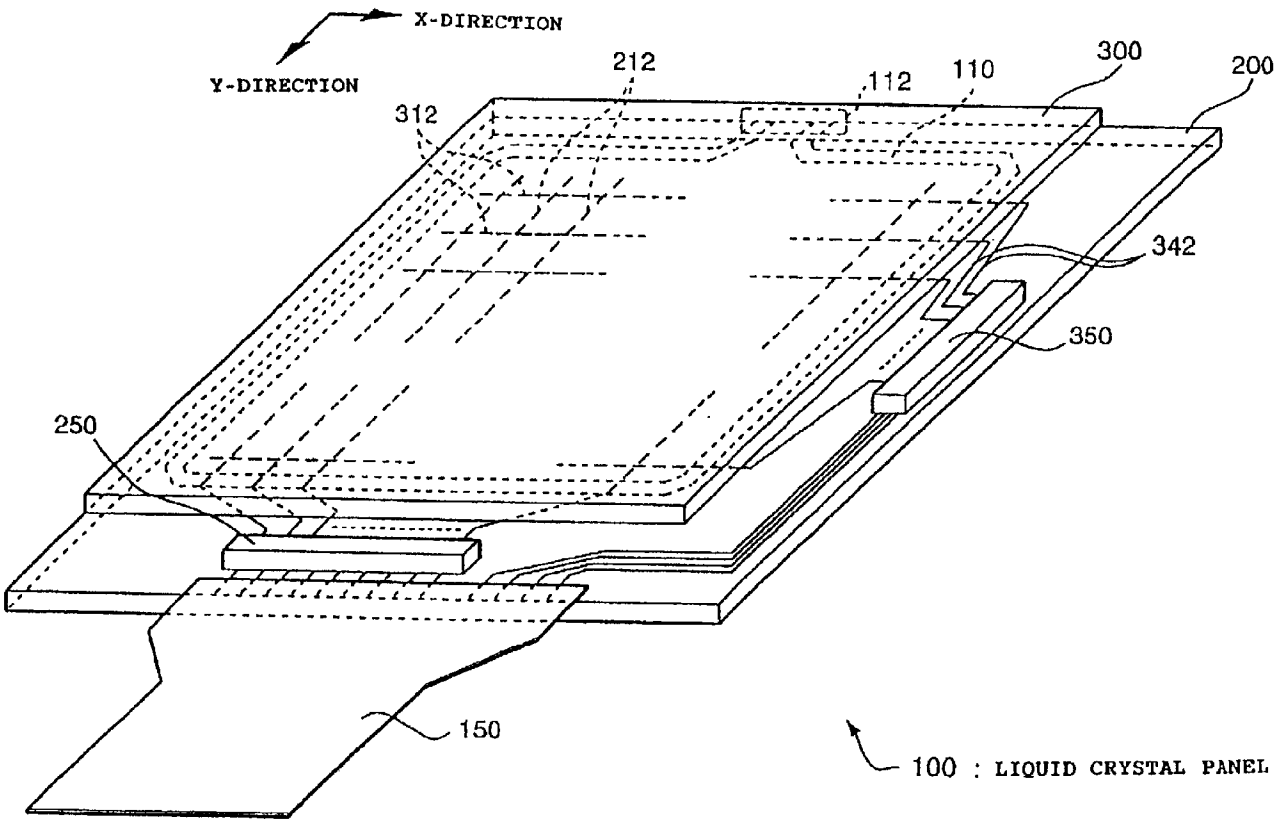
FIG. 2 is a perspective view showing the configuration of a liquid crystal panel in the display device.

Next, a description will be given of a mechanical configuration of a liquid crystal panel 100 in the display devices according to this embodiment. FIG. 2 is a perspective view showing the overall configuration of the liquid crystal panel 100, and FIG. 3 is a partially sectional view showing the configuration when the liquid crystal panel 100 is cut away along the X-direction.

Figure 3:
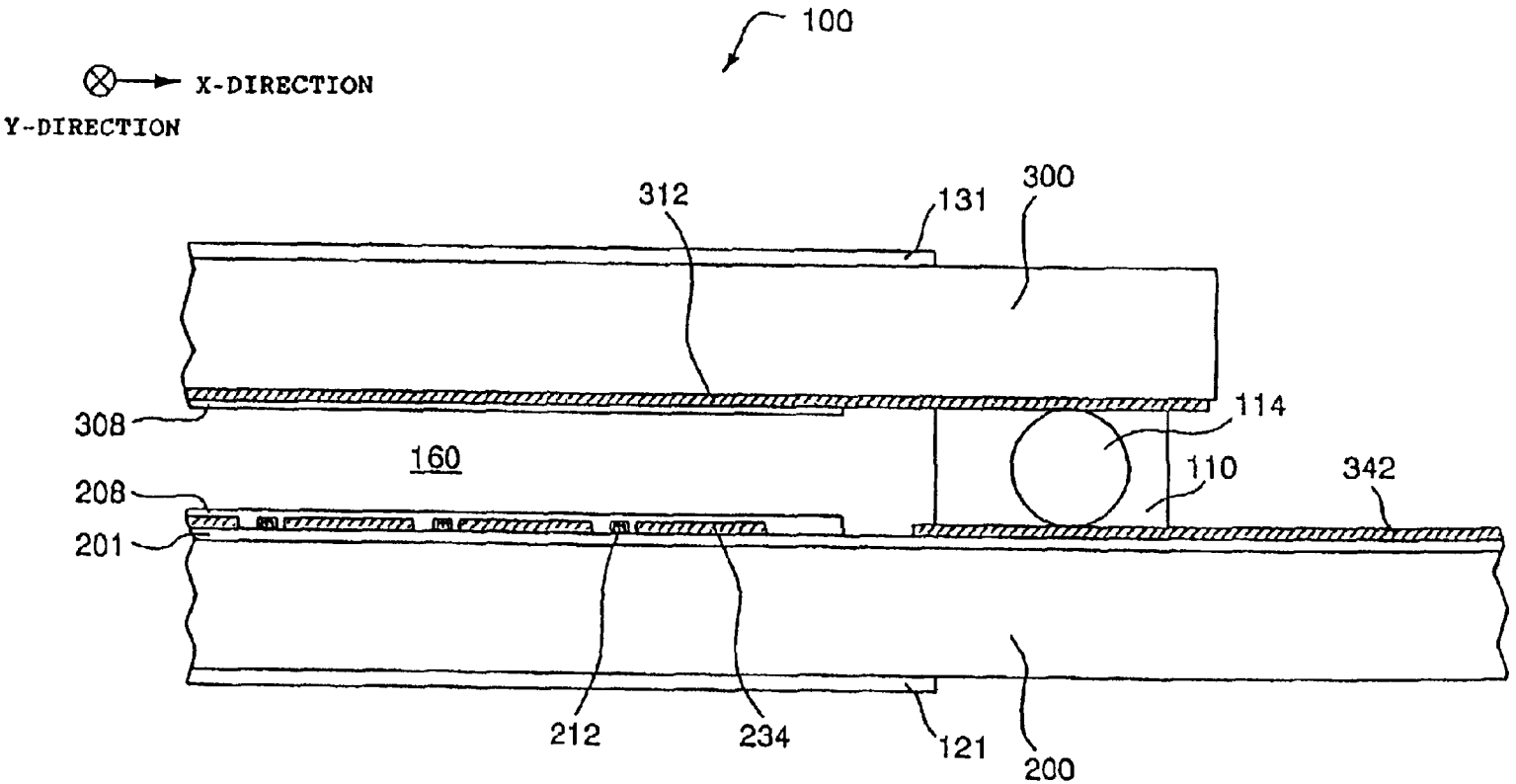
FIG. 3 is a partially sectional view showing the configuration when the liquid crystal panel is cut away along the X-direction.

As shown in FIG. 3, the liquid crystal 100 has a configuration in which a counter substrate 300 located on the side of an observer, and a device substrate 200 located on the back face thereof are bonded with maintaining a fixed gap by a seal member 110, in which a conductive particle (conductive member) 114 serving also as a spacer is mixed, and, for example, TN (Twisted Nematic) liquid crystal 160 is sealed in the gap. Incidentally, while the seal member 110 is formed in the shape of a frame on one of the substrates along the inner peripheral edge of the counter substrate 300, as shown in FIG. 2, a part thereof is opened to seal in the liquid crystal 160 therein. Therefore, after sealing in the liquid crystal, the opened part is sealed with a seal material 112.

In addition to the scanning line 312 formed in such a manner as to extend in the line (X) direction, an alignment layer 308 is formed on an opposed face of the counter substrate 300 and a rubbing treatment is applied thereto in a predetermined direction. Here, the scanning lines 312 formed on the counter substrate 300 are connected to one end of wiring 342, which is formed on the device substrate 200 and has one-to-one correspondence with each of the scanning lines 312, via the conductive particle 114 mixed in the seal member 110. That is, the scanning lines 312 formed on the counter substrate 300 are drawn out toward the device substrate 200 via the conductive particle 114 and the wiring 342. On the other hand, a polarizer 131 (not shown in FIG. 2) is bonded on the outside (observation side) of the counter substrate 300, and the absorption axis thereof is set corresponding to the direction of the rubbing treatment applied to the alignment layer 308.

Also, in addition to rectangular pixel electrodes 234 formed adjacent to the data lines 212, which are formed in such a manner as to extend in the Y (column) direction, an alignment layer 208 is formed on an opposed face of the device substrate 200, and a rubbing treatment is applied thereto in a predetermined direction. On the other hand, a polarizer 121 (not shown in FIG. 2) is bonded on the outside (opposite side of the observation side) of the device substrate 200, and the absorption axis thereof is set corresponding to the direction of the rubbing treatment applied to the alignment layer 208. In addition to this, while a backlight unit for uniformly illuminating light is provided on the outside of the device substrate 200, the backlight unit is not shown in the figure because it is not related directly to the present case.

Subsequently, a description will be given of the outside of a display region. As shown in FIG. 2, on two sides of the device substrate 200 stretching out of the counter substrate 300, the Y driver 350 for driving the scanning lines 312, and the X driver 250 for driving the data lines 212 are mounted by a COG (Chip On Glass) technology, respectively. By this, the Y driver 350 supplies scanning signals to the scanning lines 312 via the wiring 342 and the conductive particle 114, while the X driver 250 directly supplies data signals to the data lines 212.

In addition, an FPC (Flexible Printed Circuit) board 150 is connected to the vicinity of the outside of the region, on which the X driver 250 is mounted, so as to supply various signals generated by the control circuit 400 and the drive voltage generating circuit 500 (see FIG. 1) to the Y driver 350 and the X driver 250, respectively.

Incidentally, the X driver 250 and the Y driver 350 shown in FIG. 1 are, unlike shown in FIG. 2, located on the left side and the upper side of the liquid crystal panel 100, respectively, but this is only an expediential measure for describing the electrical configuration. In addition, in place of COG-mounting the X driver 250 and the Y driver 350 on the device substrate 200, respectively, a TCP (Tape Carrier Package) having the drivers mounted thereon may be electrically and mechanically connected by an anisotropic conductive film provided on a predetermined position on the substrate using, for example, a TAB (Tape Automated Bonding) technology.

Figure 4:
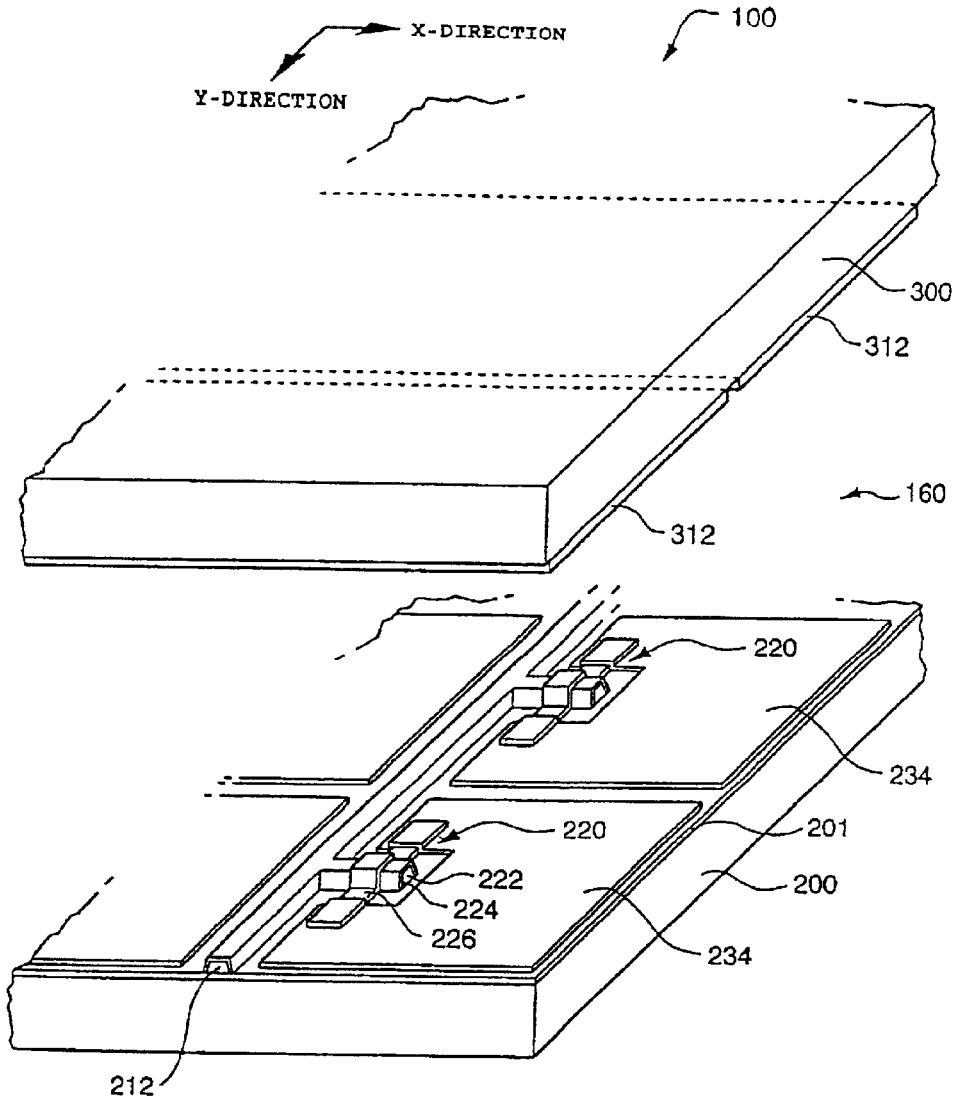
FIG. 4 is a partially cutaway perspective view showing the principal part configuration of the liquid crystal panel.

Next, a description will be given of a detailed configuration of the pixel 116 in the liquid crystal panel 100 will be described. FIG. 4 is a partially cutaway perspective view showing the structure thereof. In this figure, the alignment layers 208 and 308 and the polarizers 121 and 131 in FIG. 3 are omitted for understanding the description.

As shown in FIG. 4, rectangular pixel electrodes 234 made of a transparent conductive material, such as ITO (Indium Tin Oxide), are arranged in a matrix on an opposed surface of the device substrate 200. Among these electrodes, 200 pixel electrodes 234 arranged on the same column are commonly connected to one data line 212 via TFTs 220. Here, as viewed from the substrate, the TFD 220 is composed of a first conductor 222 made of tantalum simple substance or tantalum alloy and branched from the data line 212, an insulator 224 obtained by anodizing the first conductor 222, and a second conductor 226, such as chromium, and has a sandwich structure of conductor/insulator/conductor. Thus, the TFD 220 has diode switching characteristics according to which the current-voltage characteristics become nonlinear in both the positive direction and the negative direction.

In addition, the insulator 201 formed on the top surface of the device substrate 200 has transparency and insulating properties. The insulator 201 is formed for reasons of preventing the first conductor 222 from being peeled off by a heat treatment after the deposition of the second conductor 226, and of preventing impurities from being diffused in the first conductor 222. Therefore, in the case where this heat treatment and the impurities present no problems, the insulator 201 can be omitted.

On the other hand, the scanning lines 312 made of ITO and the like are extended on the opposed surface of the counter substrate 300 in the line direction intersecting perpendicularly to the data lines 212, and are arranged on the positions to face the pixel electrodes 234. This allows the scanning lines 312 to function as counter electrodes of the pixel electrodes 234. Therefore, at the intersection between the data line 212 and the scanning line 312, the liquid crystal layer 118 shown in FIG. 1 is composed of the scanning line 312, the pixel electrode 234, and the liquid crystal 160 located therebetween.

In addition, while color filters arranged like a stripe, a mosaic, or a triangle are provided on the counter substrate 300 according to the usage of the liquid crystal panel 100, and a black matrix is provided on a region except the color filters so as to prevent light shielding or color mixture between the pixels, a description thereof will be omitted because they are not directly related to the present case.

Figure 18:
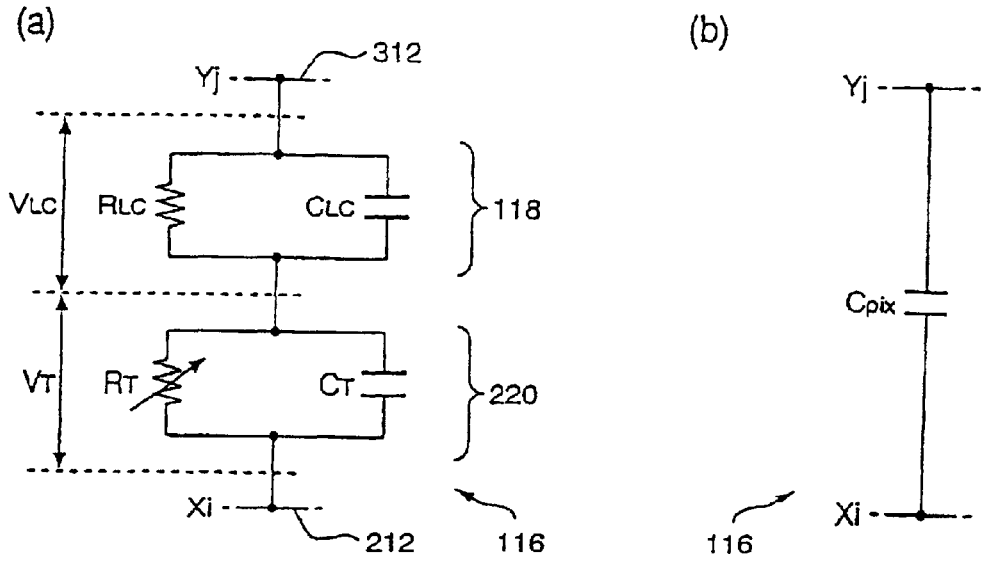
FIGS. 18(*a*) and 18(*b*) are diagrams each showing an equivalent circuit of a pixel in the display device according to the embodiments.

Incidentally, one piece of the pixels 116 having the above-described configuration can be represented by an equivalent circuit as shown in FIG. 18(*a*). That is, in general, the pixel 116 corresponding to the intersection between the scanning line 312 in the j-th (j is an integer of $1 \leqq j \leqq 200$) line and the data line 212 in the i-th (i is an integer of $1 \leqq i \leqq 160$) column can be represented by a series circuit of a TFD 220 shown by a parallel circuit of the resistance $R_T$ and the capacitance $C_T$, and a liquid crystal layer 118 shown by a parallel circuit of the resistance $R_{LC}$ and the capacitance $C_{LC}$, as shown in the figure.

Figure 19:
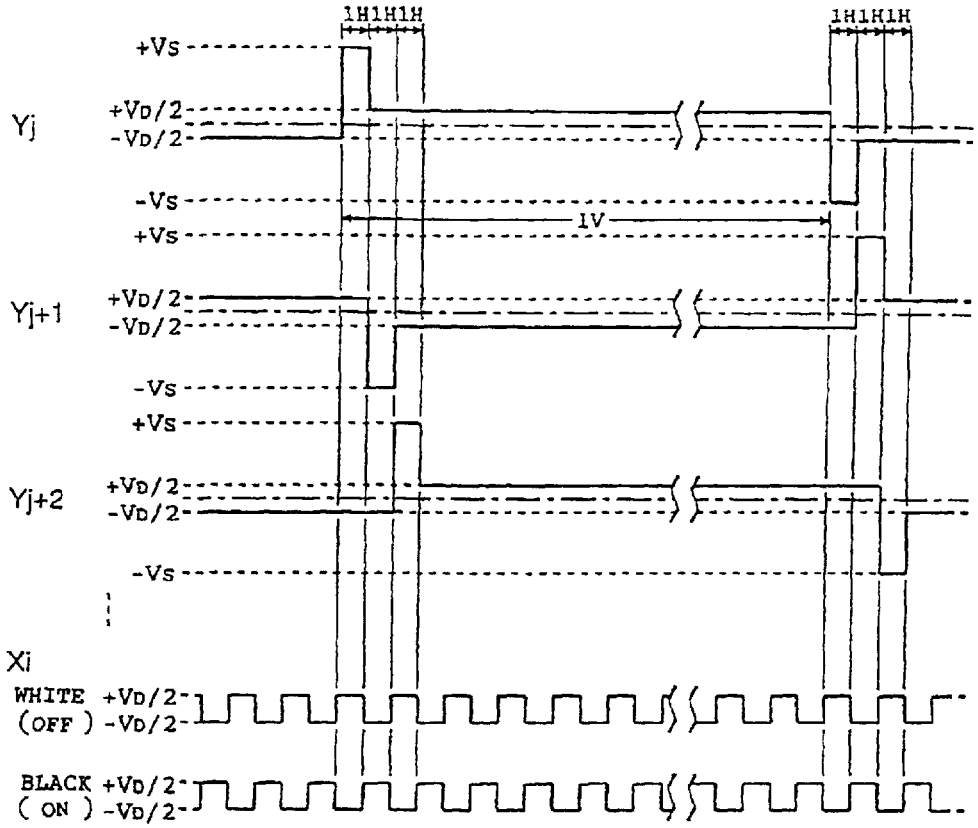
FIG. 19 is a diagram showing waveform examples of a scanning signal Yj and a data signal Xi in a four-valued driving method (1H select)

Here, a description will be given of a four-valued driving method (1H selection, 1H reversal), which is a general driving method. FIG. 19 is a diagram showing waveforms of a scanning signal Yj and a data signal Xi applied to a certain pixel 116 by the four-valued driving method (1H selection, 1H reversal). According to this driving method, after applying the selection voltage $+V_S$ as the scanning signal Yj in 1 horizontal scanning time period 1H, a non-selection voltage $+V_D/2$ is applied and held in the holding time period, and after the lapse of one vertical scanning time period (one frame) 1V from the previous selection, the selection voltage $-V_S$ is applied, and the non-selection voltage $-V_D/2$ is applied and held in the holding time period; such operations are repeated, while one of the voltages $\pm V_D/2$ is applied as the data signal Xi. In this case, an operation of reversing the polarity of the selection voltage every one horizontal scanning time period 1H is also performed such that, when the selection voltage $+V_S$ is applied as the scanning signal Yj to a certain scanning line, the selection voltage $-V_S$ is applied as the scanning signal Yj+1 to the next scanning line.

The voltage represented by the data signal Xi in this four-valued driving method (1H selection, 1H reversal) is $-V_D/2$ in the case where the selection voltage $+V_S$ is applied and the pixel 116 is ON-displayed (for example, a black display in a normally white mode), and is $+V_D/2$ when the pixel 116 is OFF-displayed (a white display in the normally white mode), while the voltage is $+V_D/2$ in the case where the selection voltage $-V_S$ is applied and when the pixel 116 is ON-displayed, and is $-V_D/2$ when the pixel 116 is OFF-displayed.

Figure 20:
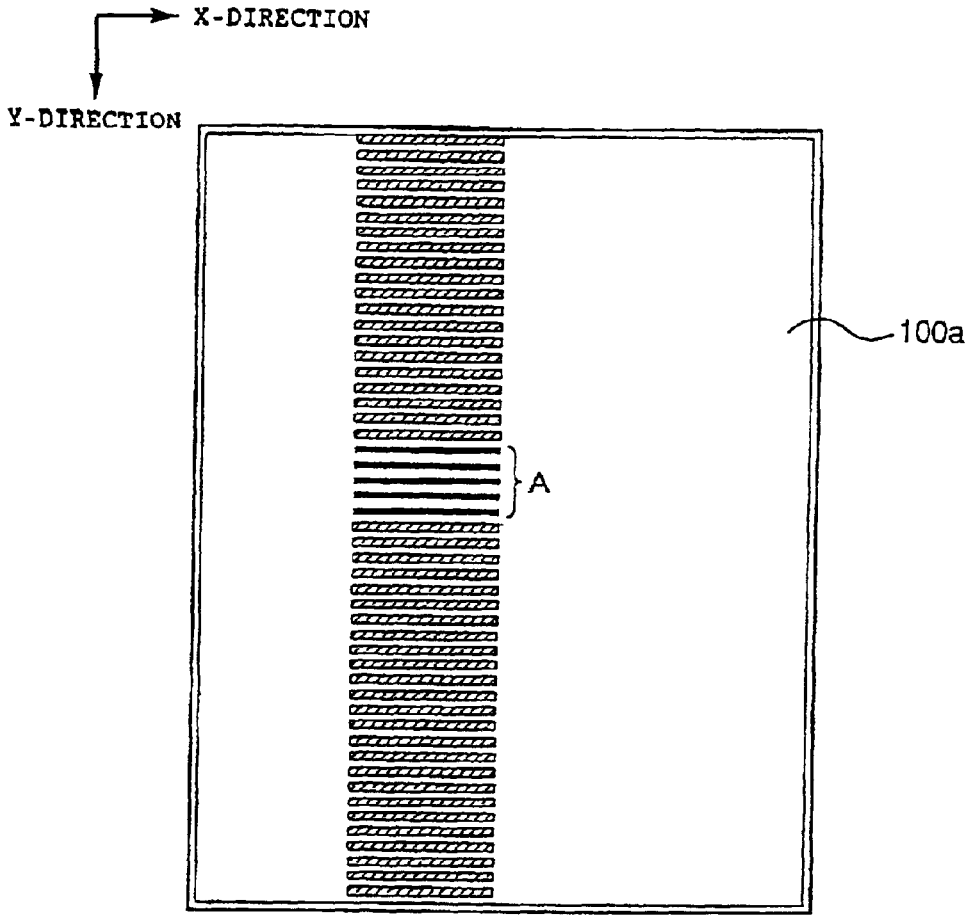
FIG. 20 is a diagram illustrating the defective condition of display.

However, according to this four-valued driving method (1H selection, 1H reversal), for example, as shown in FIG. 20, in the case where a zebra display consisting of white and black on every other line is performed in a part of a region A in a display screen 100*a*, and a simple white display is performed in other regions, a problem has been known in that crosstalk, that is, a white display with light and shade difference, occurs in the region A in the Y-direction.

The reason will be described briefly as follows. That is, when the zebra display is performed in the region A, in the data signal to the data lines included in the region A, the switching period of the voltages $\pm V_D/2$ coincides with the reversal period of the scanning signal, so that the voltage represented by the data signal is fixed to one of the voltages $\pm V_D/2$ in the time period, in which the scanning lines included in the region A are selected. When viewed from the pixel in the region adjacent to the region A in the Y-direction, this means that the voltage in a partial time period of the holding time period is fixed to one voltage. On the other hand, the selection voltages at adjacent scanning lines have polarities opposite to each other, as described above. Therefore, in the region adjacent to the region A in the Y-direction, the effective value of the voltage applied in the part of the holding time period to the pixel 116 located on the odd-numbered line differs from the effective value of the voltage applied to the pixel 116 located on the even-numbered line. As a result, in the region adjacent to the region A in the Y-direction, density difference is generated between the pixel 116 on the odd-numbered line and the pixel 116 on the even-numbered line, and the above-described crosstalk occurs.

Figure 21:
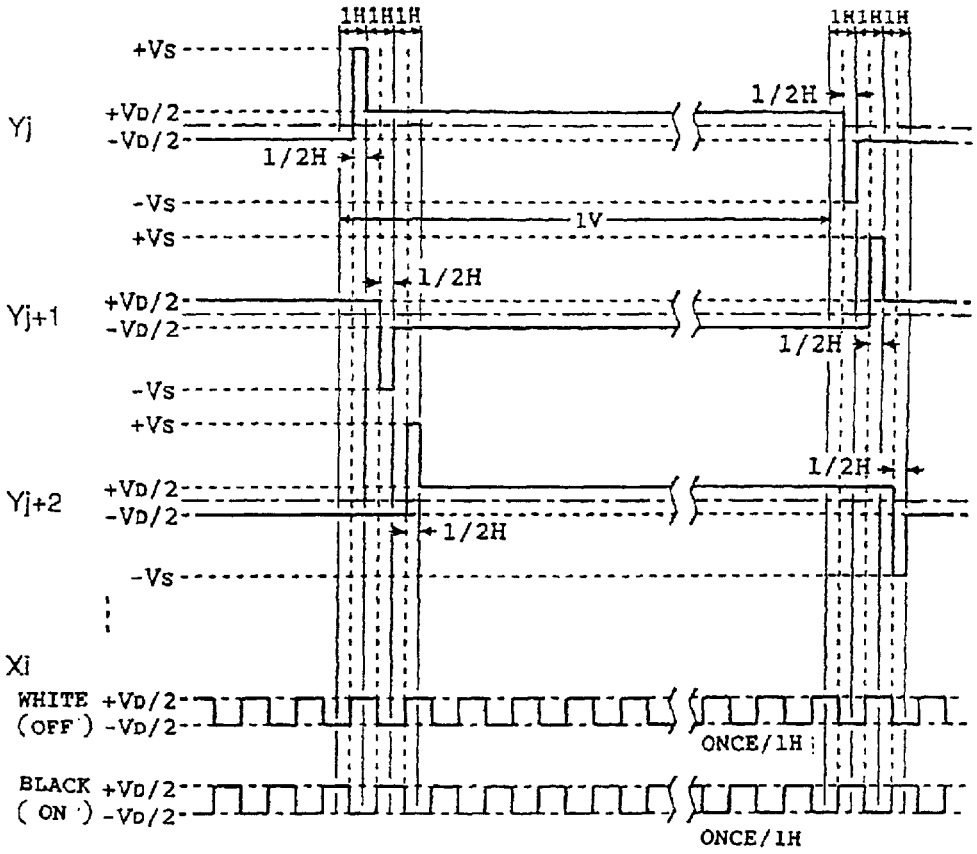
FIG. 21 is a diagram showing waveform examples of a scanning signal Yj and a data signal Xi in a four-valued driving method (½H select)
Figure 22:
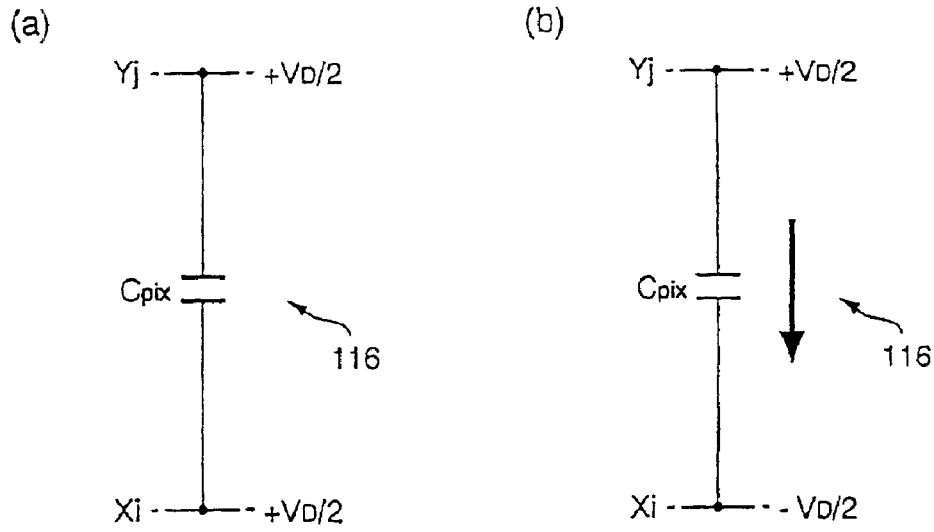
FIGS. 22(*a*) and 22(*b*) are diagrams each illustrating the power consumption caused by voltage switching of the data signal Xi in a non-selection time period (holding time period)

Thus, in order to solve the problem of the crosstalk, a four-valued driving method (½H selection, 1H reversal) is employed. As shown in FIG. 21, this four-valued driving method (½ selection, 1H reversal) divides the one horizontal scanning time period 1H in the four-valued driving method (1H selection, 1H reversal) into a first half time period and a second half time period, selects the scanning line in, for example, the second half time period ½H, and sets the ratio between the time periods in which the voltages $-V_D/2$ and $+V_D/2$ are applied in the one horizontal scanning time period 1H to 50%. According to this four-valued driving method (½H selection, 1H reversal), even if any pattern is displayed, the application time period of the voltage $-V_D/2$ and the application time period of the voltage $+V_D/2$ in the data signal Xi are half and half to each other, so that the occurrence of the above-described crosstalk is prevented.

Incidentally, in the display device according to this embodiment, the total number of the scanning lines 312 is 200, so that the holding time period (non-selection time period) in the one vertical scanning time period is 199H, which is 199 times as long as the one horizontal scanning time period 1H. In this holding time period, since the TFD 220 is turned off, the resistance $R_T$ thereof is sufficiently high, and the resistance $R_{LC}$ is sufficiently high, regardless of ON or OFF of the TFD 220. For this reason, the equivalent circuit of the pixel 116 in the holding time period can be represented by the capacity $C_{PIX}$ consisting of a series-combined capacity of the capacity $C_T$ and the capacity $C_{LC}$, as shown in FIG. 18(*b*). Here, the capacity $C_{PIX}$ is represented by $(C_T \cdot C_{LC})/(C_T+C_{LC})$.

Figure 5:
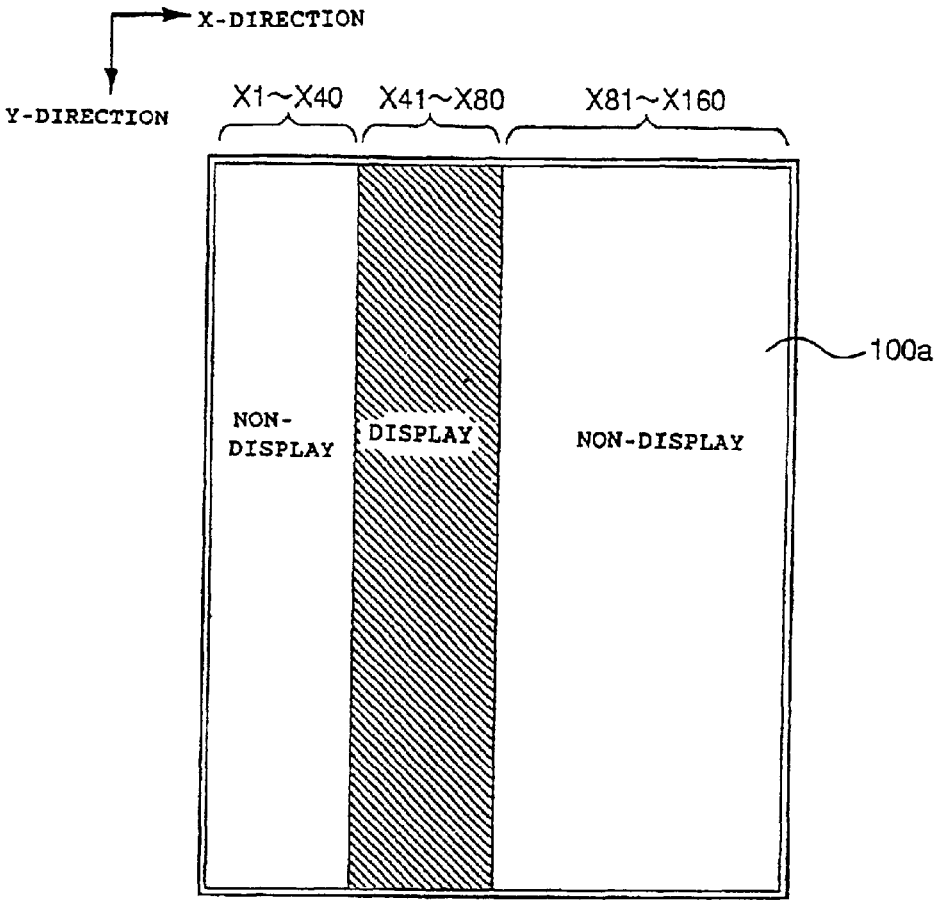
FIG. 5 is a diagram illustrating the display modes of the liquid crystal panel.

Now, in the liquid crystal panel 100, as shown in FIG. 5, for example, a case will be considered where only the pixels located on the data lines 212 in the 41st column to 80th column counted from the left are regarded as a display region, and the pixels located on the data lines 212 in the first column to 40th column and in the 81st column to 160th column are regarded as non-display regions. In this case, a method may be simply considered for setting the data signals X41 to X80 of the data lines 212 belonging to the display region to correspond to the contents to be displayed in the display region, while setting the data signals X1 to X40 and X81 to X160 of the data lines belonging to the non-display regions to correspond to the OFF (white) display.

In this method, however, even in the non-selection time period, charging and discharging of the pixel capacity $C_{PIX}$ of the non-display region are frequently performed, so that the power consumption cannot be greatly suppressed. This point will be described in detail. As shown in FIG. 21, in the case where, for example, the scanning line 312 on the j-th line is not selected, and the non-selection voltage represented by the scanning signal Yj applied to the scanning line is held at, for example, $+V_D/2$, the voltage represented by the data signal to the data lines 212 corresponding to the white display is alternately switched between $+V_D/2$ and $-V_D/2$ every half time period (½H) of the one horizontal scanning time period 1H, so that charging and discharging are performed twice per one horizontal scanning time period 1H on the pixel capacity CLC (that is, the pixel capacity $C_{PIX}$ of the non-display region) which corresponds to the intersections between the scanning line 312 in the j-th line and the data lines in the 1st to 40th columns and 81st to 160th columns.

Therefore, according to this method, even in the non-selection region, as regards one pixel 116, the charge of $C_{PIX} \cdot V_D$ is supplied by the voltage switching in the holding (non-selection) time period, so that the power is consumed by the capacity load in the pixel 116.

Thus, the display device according to this embodiment sets the polarity reversal period of the selection signal to be two or more horizontal scanning time periods, maintains the voltage of the data signal of the data lines 212 included on the non-display region in the voltage corresponding to the OFF (white) display over the 1 horizontal scanning time period to decrease the voltage switching frequency of the data signal included in the non-display region, whereby the power consumed in the pixel of the non-display region is suppressed. Circuits for performing such a driving will now be described.

Figure 7:
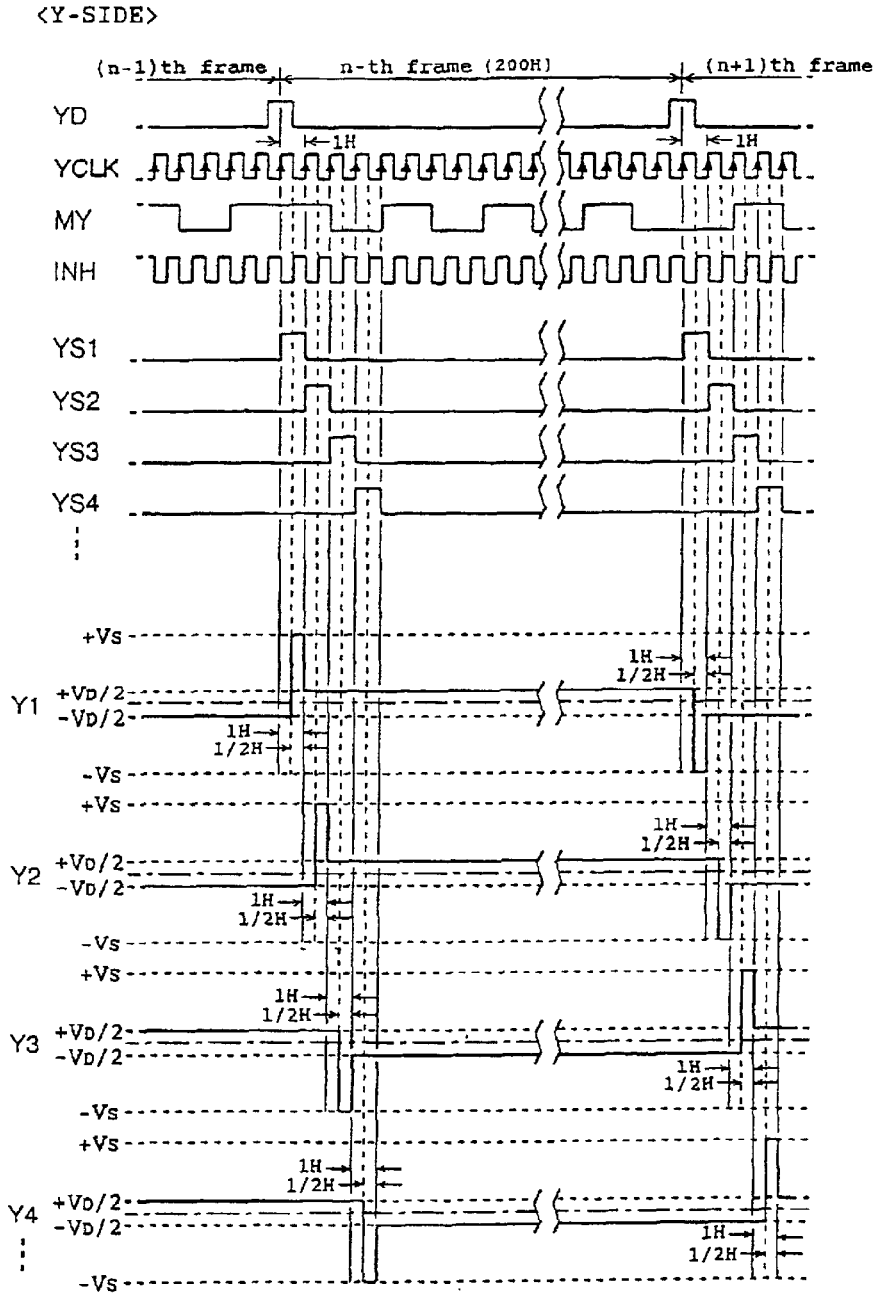
FIG. 7 is a timing chart illustrating the operation of the Y driver.

To this end, the control circuit 400 in FIG. 1 generates various control signals and clock signals, which will be described below. First, a start pulse YD is outputted at the beginning of 1 vertical scanning time period (one frame) as shown in FIG. 7. Second, a clock signal YCLK is a scanning-line-side reference signal, and has a period of 1H that is equivalent to one horizontal scanning time period, as shown in FIG. 7. Third, an alternate current driving signal MY is a signal for defining the polarity of a selection voltage of the scanning signal, the signal level thereof is reversed every two horizontal scanning time periods 2H, and the signal level is reversed every one vertical scanning time period in the two horizontal scanning time periods 2H in which the same two scanning lines are selected, as shown in FIG. 7. Fourth, a control signal INH is a signal for defining a time period of applying the selection voltage in the one horizontal scanning time period 1H, and in this embodiment, as shown in FIG. 7, the control signal has the same period as the clock signal YCLK, and is put into an H-level active in a second half time period of the one horizontal scanning time period 1H.

Figure 9:
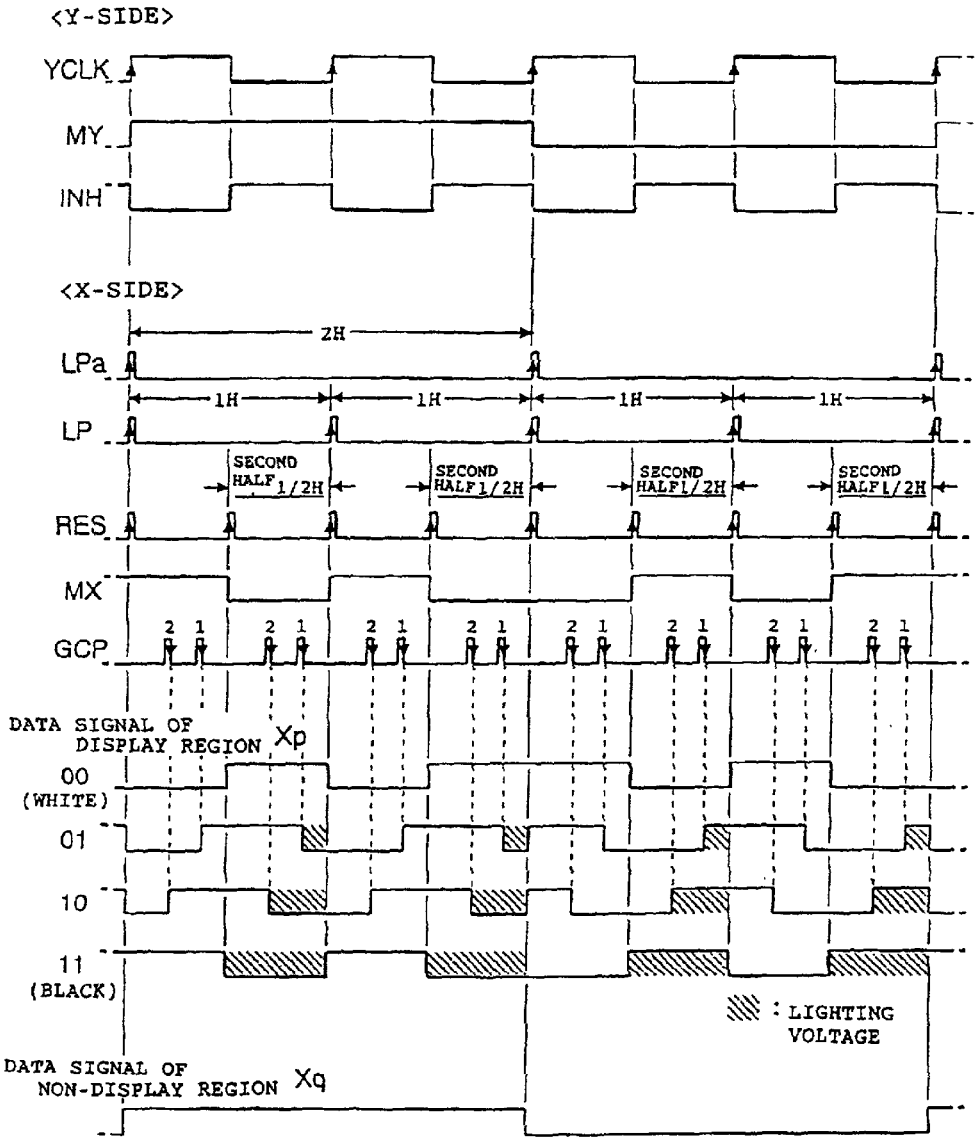
FIG. 9 is a timing chart illustrating the operation of the X driver.

Fifth, a latch pulse LPa is a pulse outputted with the timing of changing the logical level of the alternate current driving signal MY, that is, a pulse outputted every two horizontal scanning time periods 2H, as shown in FIG. 9. Sixth, a latch pulse LP is used for latching data signals at the data-line side, and outputted at the beginning of one horizontal scanning time period, as shown in FIG. 9. Seventh, a reset signal RES is a pulse outputted at the beginning of the first half time period and at the beginning of the second half time period of one horizontal scanning time period at the data-line side, as shown in FIG. 9.

Eighth, an alternate current driving signal MX is a signal for defining the polarity of the data signal when it is ON-displayed, and the logical level thereof is obtained by reversing the level of the alternate current driving signal MY when the control signal INH is at an H-level (the time period in which the selection voltage is actually applied), while the logical level is obtained by maintaining the level of the alternate current driving signal MY when the control signal INH is at an L-level, as shown in FIG. 9.

Ninth, a gray scale code pulse GCP is a pulse arranged at the position of the time period on the proximal side from each of the end points of the first half time period and the second half time period, into which one horizontal scanning time period 1H is divided, according to the level of the intermediate gray scale, as shown in FIG. 9. Here, in this embodiment, when it is assumed that gray scale data for designating the intensity of the pixel is represented by two bits to present a four-gray scale display, and that the gray scale data (00) designates the OFF (white) display, while the gray scale data (11) designates the ON (black) display, two gray scale code pulses GCP corresponding to gray (01) and (10) except white and black are arranged corresponding to the intermediate gray scale level in each of the first half time period and the second half time period. More specifically, the gray scale data (01) and (10) correspond to "1" and "2" of the gray scale code pulse GCP in FIG. 9. Incidentally, in FIG. 9, the gray scale code pulse GCP is actually set according to the applied voltage-intensity characteristic (V-I characteristic).

Tenth, a data PDx is a data for specifying the data line 212, which presents non-display, when the partial display is performed. For example, if the partial display is as shown in FIG. 5, the data PDx specifies the data lines 212 in the first to 40th columns and in the 81st to 160th columns.

Figure 6:
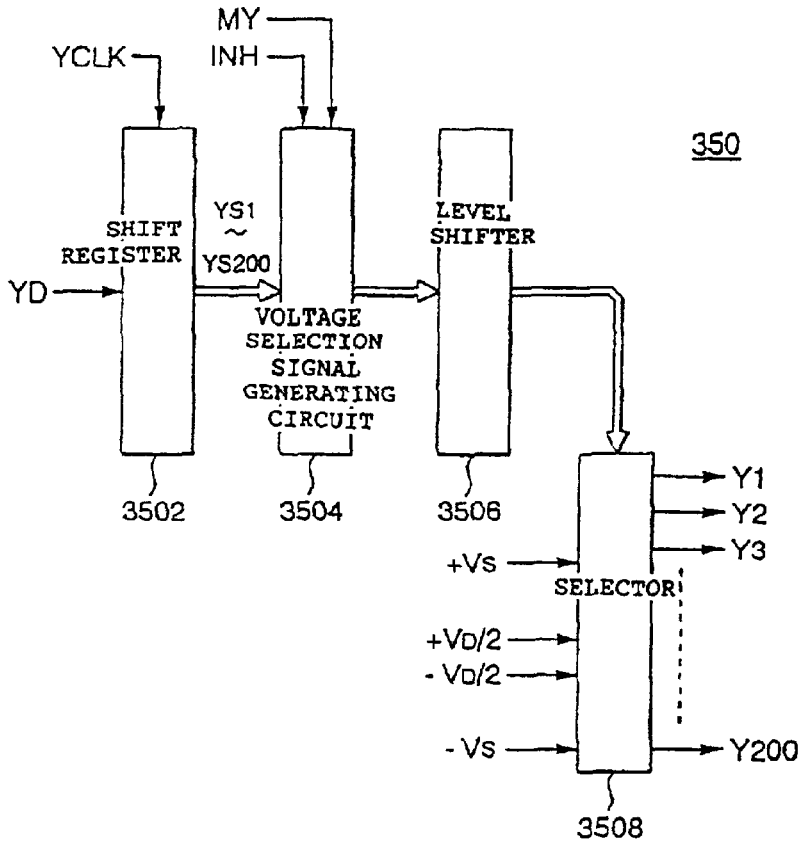
FIG. 6 is a black diagram showing the configuration of a Y driver in the display device.

Next, the detail of the Y driver 350 will be described. FIG. 6 is a block diagram showing the configuration of this Y driver 350. In this figure, a shift register 3502 is a 200-bit shift register which corresponds to the total number of scanning lines 312, shifts a start pulse YD supplied at the beginning of one frame according to clock signals YCLK having a period of one horizontal scanning time period, and sequentially outputs the shifted pulses as transfer signals YS1, YS2, . . . , YS200. Here, the transfer signals YS1, YS2, . . . , YS200 correspond to the scanning lines 312 on the first, second, . . . , 200th lines in a one-to-one correspondence relationship, and means, when one of the transfer signals is at an H-level, the scanning line 312 corresponding thereto should be selected.

Subsequently, a voltage selection signal generating circuit 3504 outputs a voltage selection signal used for determining a voltage, which is to be applied to each of the scanning lines 312, from the alternate current driving signal MY and the control signal INH. Here, in this embodiment, the voltage represented by the scanning signals applied to the scanning lines 312 has the following four values: $+V_S$ (a positive-side selection voltage), $+V_D/2$ (a positive-side non-selection voltage), $-V_S$ (a negative-side selection voltage), and $-V_D/2$ (a negative-side non-selection voltage), as described above, and among these values, a time period, in which the selection voltage $+V_S$ or $-V_S$ is actually applied thereto, is the second half time period ½H of the one horizontal scanning time period. Further, the non-selection voltage after the application of the selection voltage $+V_S$ thereto is $+V_D/2$, and is $-V_D/2$ after the application of the selection voltage $-V_S$ and thus, the non-selection voltage is directly and exclusively determined by the immediately preceding selection voltage.

For this reason, the voltage selection signal generating circuit 3504 generates the voltage selection signal so that the voltage level indicated by the scanning signals Y1, Y2, . . . , Y200 is determined as follows. That is, when one of the transfer signals YS1, YS2, . . . YS200 is at an H-level and selection of the scanning line 312 corresponding thereto is designated, the voltage selection signal generating circuit 3504 generates a voltage selection signal so that, first, the voltage level of the scanning signal is a selection voltage corresponding to an alternate current driving signal MY in a time period in which the control signal INH is at an H-level and second, when the signal level of the control signal INH is changed to an L-level, the signal level of the scanning signal becomes that of the non-selection voltage corresponding to the selection voltage.

More specifically, in the case where the alternate current driving signal MY is at an H-level in the time period, in which the control signal INH is brought into an H-level state, the voltage selection signal generating circuit 3504 outputs a voltage selection signal for selecting the positive-side selection voltage $+V_S$ during the time period, and thereafter, outputs a voltage selection signal for selecting the positive-side non-selection voltage $+V_D/2$, while, in the case where the alternate current driving signal MY is at an L-level, the voltage selection signal generating circuit 3504 outputs a voltage selection signal for selecting the negative-side selection voltage $-V_S$ during the time period, and thereafter, outputs a voltage selection signal for selecting the negative-side non-selection voltage $-V_D/2$. And, the voltage selection signal generating circuit 3504 executes the generation of such voltage selection signals corresponding to each of the 200 scanning lines 312.

The level shifter 3506 increases the voltage amplitude of the voltage selection signal outputted by the voltage selection signal generating circuit 3504. And, the selector 3508 actually selects the voltage indicated by the voltage selection signal whose voltage amplitude is increased, and applies the voltage to each of the corresponding scanning lines 312.

Next, the voltage waveform of the scanning signal supplied by the Y driver 350 of the aforementioned configuration is as shown in FIG. 7. That is, the start pulse YD is sequentially shifted every one horizontal scanning time period 1H according to the clock signal YCLK, and such shifted pulses are outputted as the transfer signals YS1 to YS200, and the second half time period ½H of the one horizontal scanning time period 1H is selected by the control signal INH and further, the selection voltage for the scanning signal is determined according to the level of the alternate current driving signal MY in the second half time period, so that the scanning-signal voltage supplied to one scanning line is the positive-side selection voltage $+V_S$ if the alternate current driving signal MY is at, for example, an H-level in the second half time period of the one horizontal scanning time period in which the scanning line is selected and thereafter, the positive-side non-selection voltage $+V_D/2$ corresponding to the selection voltage is held. Then, after the lapse of one frame, the level of the alternate current driving signal MY is reversed to an L-level in the second half time period of the one horizontal scanning time period, so that the scanning-signal voltage supplied to the scanning line is the negative-side selection voltage $-V_S$ and thereafter, the negative-side non-selection voltage $-V_D/2$ corresponding to the selection voltage is held.

For example, as shown in FIG. 7, the voltage represented by the scanning signal Y1 to the scanning line 312 on the first line in an n-th frame is the positive-side selection voltage $+V_S$ in the second half time period of the horizontal scanning time period and thereafter, the positive-side non-selection voltage $+V_D/2$ is held, and in the second half time period of the next one horizontal period, the level of the alternate current driving signal MY is reversed to an L-level from the previous selection, so that the voltage represented by the scanning signal Y1 to the scanning line is the negative-side selection voltage $-V_S$ and thereafter, the negative-side non-selection voltage $-V_D/2$ is held, and such a cycle is repeated.

In addition, the signal level of the alternate current driving signal MY is reversed every two horizontal scanning time periods 2H, so that the polarity of the voltage represented by the scanning signal supplied to each of the scanning lines 312 is reversed every two horizontal scanning time periods 2H, that is, every two scanning lines. For example, as shown in FIG. 7, in an n-th frame, the selection voltage of both of the scanning signal Y1 in the first line and the scanning signal Y2 in the second line is the positive-side selection voltage $+V_S$ and further, the selection voltage of both of the subsequent scanning signal Y3 in the third line and the scanning signal Y4 in the fourth line is the negative-side selection voltage $-V_S$.

Figure 8:
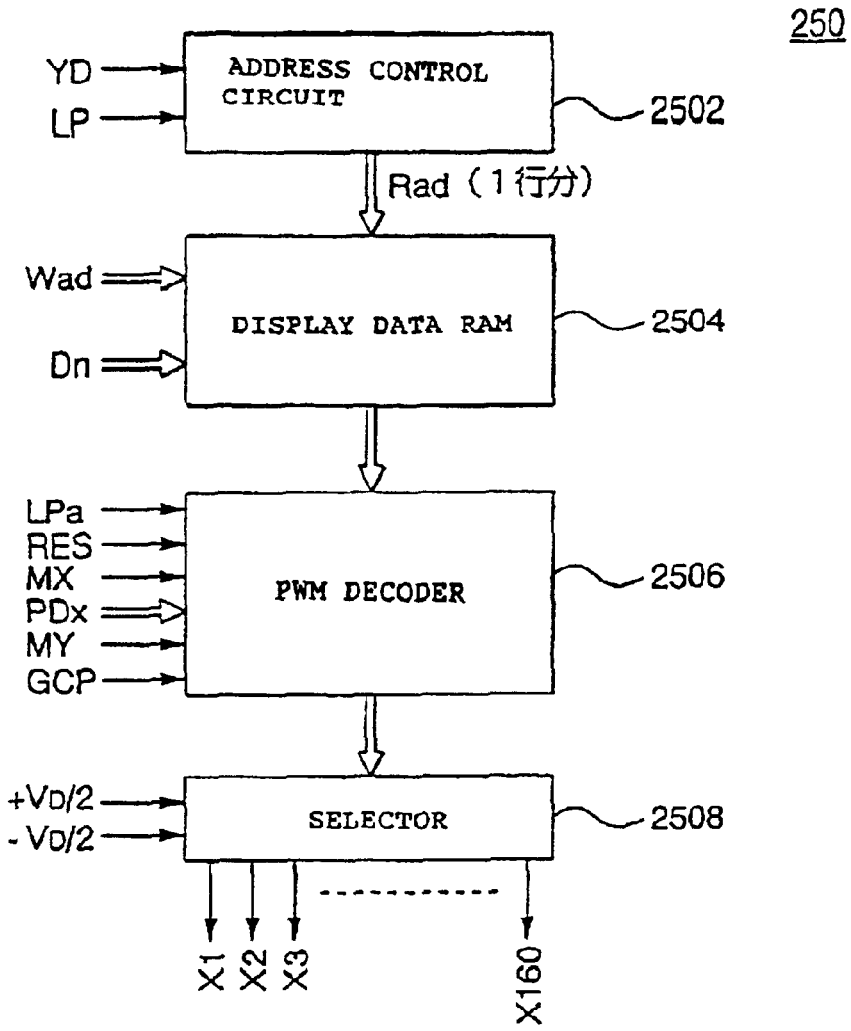
FIG. 8 is a block diagram showing the configuration of an X driver in the display device.

Next, the details of the X driver 250 will be described. FIG. 8 is a block diagram showing the configuration of this X driver 350. In this figure, an address control circuit 2502 generates a line of address Rad used for reading gray scale data, and the address Rad is reset in response to the start pulse YD supplied at the beginning of one frame, and is incremented in response to a latch pulse LP supplied every one horizontal scanning time period.

Subsequently, a display data RAM 2504 is a dual port RAM having a region corresponding to data of 200×160 pixels. On the writing side, a gray scale data Dn supplied from a processing circuit (not shown) is written in an address corresponding to a writing address Wad, while, on the reading side, one line of gray scale data (160 pieces) in the addresses designated by the address Rad are collectively read.

Next, a PWM decoder 2506 generates a voltage selection signal for selecting the voltages of the data signals X1, X2, . . . , X160 from the reset signal RES, the alternate current driving signal MX, and the gray scale code pulse GCP according to the read one line of gray scale data Dn.

In this embodiment, the voltage represented by the data signal applied to the data lines 212 is one of $+V_D/2$ and $-V_D/2$, and the gray scale data is 2 bits in length (4 gray scale levels), as described above. Thus, the PWM decoder 2506 generates voltage selection signals so that the voltage level of the data signal is established as follows with respect to each of the read one line of gray scale data Dn.

That is, the PWM decoder 2506 pays attention to one gray scale data Dn, and if the gray scale data designates an intermediate gray scale (gray) display other than the ON display and OFF display, the PWM decoder 2506 generates a voltage selection signal so that, first, the polarity thereof is reset to be opposite to the polarity represented by the logical level of the alternate current driving signal MX at the rising edge of the latch pulse LPa. Second, at the falling edge of one of the gray scale code pulses GCP corresponding to the gray scale data Dn, the polarity is set to the same polarity as that represented by the logical level of the alternate current driving signal MX. Subsequently, the above setting and resetting are repeated until the next latch pulse LPa is supplied. On the other hand, the PWM decoder 2506 generates a voltage selection signal using the reset signal RES and the like so that, when the gray scale data Dn is (00) corresponding to the OFF (white) display, the polarity thereof is set to be opposite to the polarity represented by the logical level of the alternate current driving signal MX, and that, when the gray scale data Dn is (11) corresponding to the ON (black) display, the polarity is set to the same polarity as that represented by the logical level of the alternate current driving signal MX. The PWM decoder 2506 executes the generation of such voltage selection signals corresponding to each of read 160 gray scale data Dn. However, the PWM decoder 2506 generates a voltage selection signal for the data line 212 specified by the data PDx so that the signal has the polarity represented by the logical level of the alternate current driving signal MY, regardless of the corresponding gray scale data Dn.

The selector 2508 actually selects the voltage indicated by the voltage selection signal, which is generated by the PWM decoder 2506, and applies the selected voltage to each of the corresponding data lines 212.

Eventually, the voltage waveforms of the data signals supplied by the X driver 250 are as shown in FIG. 9. That is, the data signal Xp (in the example shown in FIG. 5, Xp is X41 to X80) to the data lines 212 belonging to the display region corresponds to the gray scale data Dn of the pixel 116 corresponding to the intersection between the selected scanning line 312 and the corresponding data line 212 on the p-th column, and, the polarity of the data signal Xq (in the example shown in FIG. 5, Xq is X1 to X40 and X81 to X160) to the data lines 212 belonging to the non-display region is the same as the polarity represented by the logical level of the alternate current driving signal MY, that is, the polarity of the selection voltage. Incidentally, FIG. 9 shows a case where the data signals Xp have the same gray scale data Dn of four pixels adjacent one to the other in the Y-direction.

Figure 10:
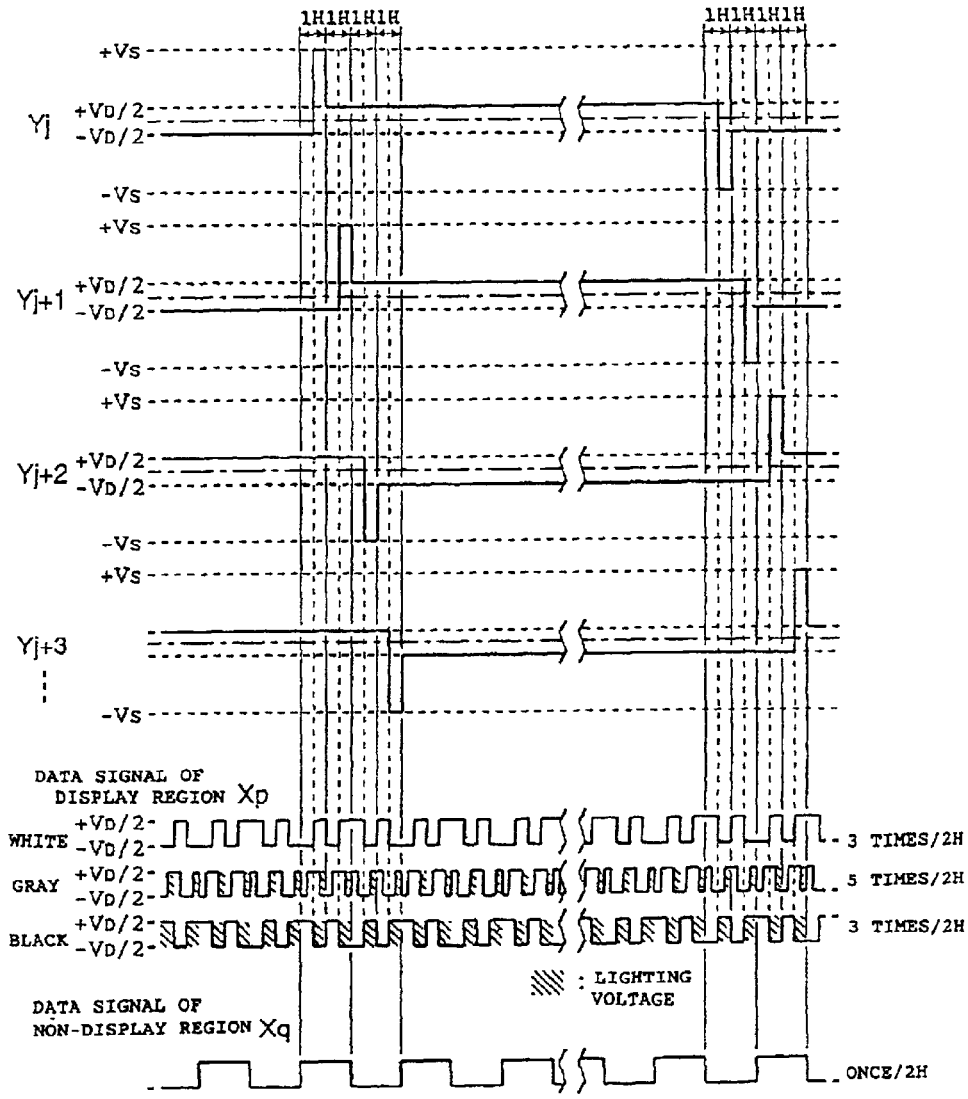
FIG. 10 is a timing chart showing the voltage waveforms formed by the X driver and the Y driver in connection with gray scale of pixels.

Voltage switching frequencies of the data signals Xp and Xq will be studied with reference to FIG. 10. In this embodiment, the voltage switching frequency of the data signal Xp to the data lines 212 belonging to the display region is, when the OFF (white)-displayed or ON (black)-displayed pixels continue in the column direction, three times per two horizontal scanning time periods 2H in which scanning lines having the same polarity of the selection voltage are selected, and is five times per the two horizontal scanning time periods 2H when the gray-displayed pixels continue in the column direction. For this reason, as simply compared with the conventional four-valued driving method (½ selection, 1H reversal) shown in, the voltage switching frequency of the data signal included in the display region is increased. However, the voltage switching frequency of the data signal Xq to the data lines 212 belonging to the non-display region is once per the two horizontal scanning time periods 2H, and the voltage switching frequency is reduced by half, as compared to the case where signals corresponding to the OFF (white) display are simply supplied.

Therefore, in the display device according to this embodiment, when the partial display as shown in FIG. 5 is performed, if the decrement of power consumption due to the reduction in the voltage switching frequency of the data signal Xq included in the non-display region exceeds the increment of the power consumption due to the increase in the voltage switching frequency of the data signal Xp included in the display region, the power consumption is reduced. Actually, the partial display as shown in FIG. 5 is performed during, such as standby, which is different from a normal operation, and only a display of minimum information is sufficient, so that a very small number of data lines 212 is required for the display region. For this reason, it can be considered that the increment of the power consumption due to the increase in the voltage switching frequency of the data signal Xp included in the display region can be almost ignored, and that it is sufficient to study only the effect of the low power consumption due to the decrease in the voltage switching frequency of the data signal Xq to the non-display region.

Figure 11:
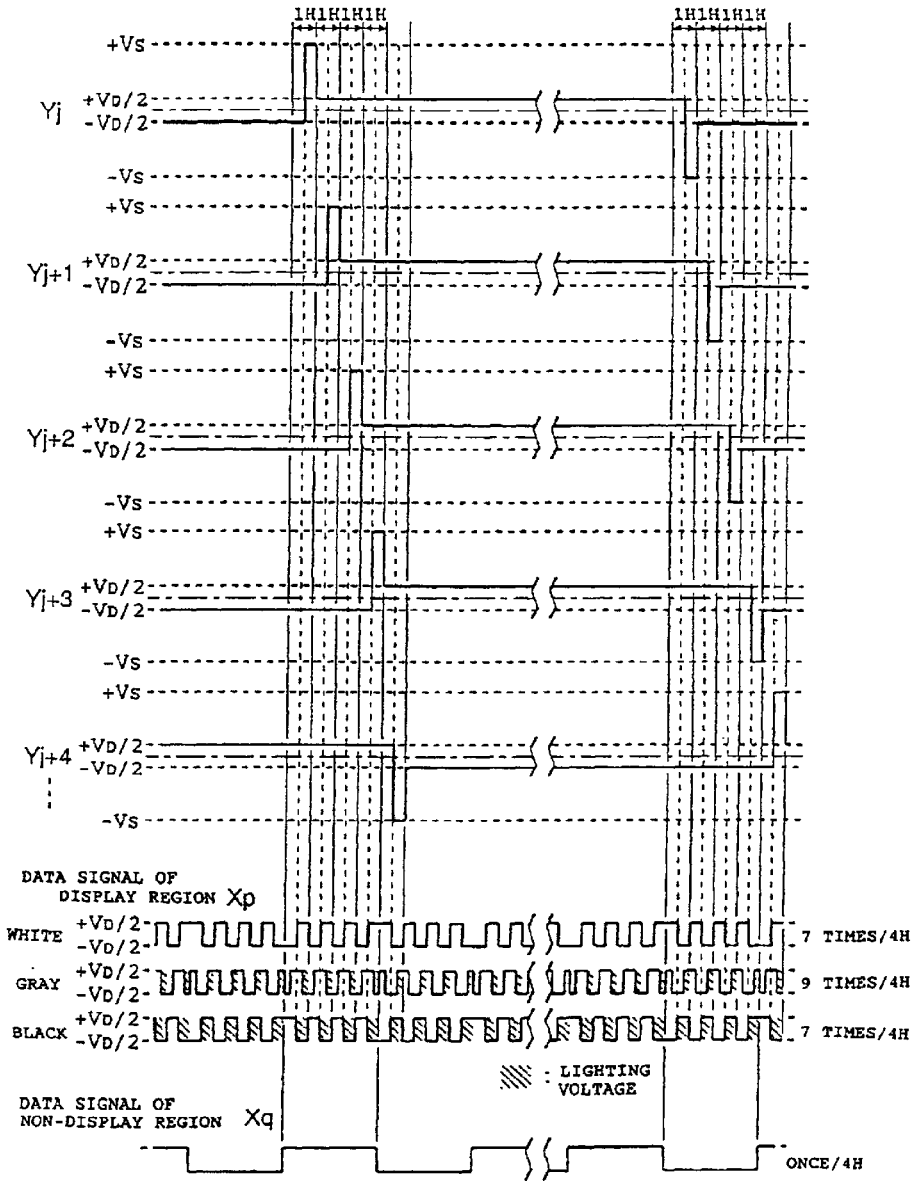
FIG. 11 is a timing chart showing the voltage waveforms according to a modification of the first embodiment in connection with gray scale of pixels.

While the polarity of the selection voltage is reversed every 2 horizontal scanning time periods in the first embodiment, the present invention is not limited thereto, and the polarity may be reversed every three or more horizontal scanning time periods. For example, as shown in FIG. 11, the polarity of the selection voltage may be reversed every 4 horizontal scanning time periods 4H.

In the configuration in which the polarity of the selection voltage is reversed every four horizontal scanning time periods 4H, the voltage switching frequency of the data signal Xp to the data lines 212 belonging to the display region is, when the OFF (white)-displayed or ON (black)-displayed pixels continue in the column direction, seven times per four horizontal scanning time periods 4H in which the scanning lines having the same polarity of the selection voltage are selected, and is nine times per the four horizontal scanning time periods 4H when the gray-displayed pixels continue in the column direction. For this reason, even as compared with the conventional four-valued driving method (½ selection, 1H reversal) shown in FIG. 21, there is no wide difference between the voltage switching frequencies of the data signals included in the display region. Further, the voltage switching frequency of the data signal Xq to the data lines 212 belonging to the non-display region is once per the 4 horizontal scanning time periods 4H, so that the voltage switching frequency is remarkably decreased.

In this embodiment, in general, if the polarity reversal period of the selection voltage is set to m-horizontal scanning time periods, the voltage switching frequency of the data signal Xp to the data lines 212 belonging to the display region is (2m−1) times per m-horizontal scanning time periods mH when the OFF (white)-displayed or ON (black)-displayed pixels continue in the column direction, and is (2m+1) times per the m-horizontal scanning time periods mH when the gray-displayed pixels continue in the column direction. Further, the voltage switching frequency of the data signal Xq to the data lines 212 belonging to the non-display region is once per m-horizontal scanning time periods mH.

Therefore, as the polarity reversal period of the selection voltage is extended, the voltage switching frequency of the data signal Xp included in the display region approaches to once per one horizontal scanning time period 1H, and the voltage switching frequency of the data signal Xq to the non-display region is decreased, so that the power consumption can be further reduced.

Incidentally, the polarity reversal period of the selection voltage coincides with the reversal period of the logical level of the alternate current driving signal MY, as described above. For this reason, the polarity reversal period of the selection voltage can be set to a desired period only by operating the reversal period of the logical level of the alternate current driving signal MY.

In addition, while the voltage switching timing of the data signal Xq to the non-display region is set at the beginning of one horizontal scanning period in which one scanning line 312 is selected in the above description, since the selection voltage is applied in the second half time period ½, the switching timing may be set at the beginning of the second half time period. That is, as regards the data signal Xq to the non-display region, the voltage switching timing may be delayed by the ½H of one horizontal scanning time period with respect to FIG. 9, 10, or 11. Further, while the time period in which the selection voltage is applied is the second half time period of the one horizontal scanning time period 1H, the time period may be, of course, the first half time period.

In the above-described first embodiment, while the voltage switching frequency of the data signal Xq to the non-display region is decreased, the voltage switching frequency of the data signal Xp to the display region tends to increase. Thus, a description will be given of a second embodiment having an object to decrease the voltage switching frequency of the data signal Xp to the display region. Incidentally, a display device according to the second embodiment differs from that of the first embodiment only in the control signal, and the mechanical and electrical configurations are the same as in the first embodiment. For this reason, as regards the second embodiment, a portion different from that of the first embodiment will be mainly described.

In the second embodiment, however, the polarity reversal period of the selection voltage is four horizontal scanning time periods 4H. For this reason, the logical level of the alternate current driving signal MY is set so as to be reversed every four horizontal scanning time periods 4H. More specifically, the logical level of the alternate current driving signal MY is set so as to be reversed every four horizontal scanning time periods 4H in which four scanning lines 312 are selected such that the 1st line to the 4th line, the 5th line to the 8th line, the 9th line to the 12th line, . . . , the 197th line to the 200th line.

Figure 12:
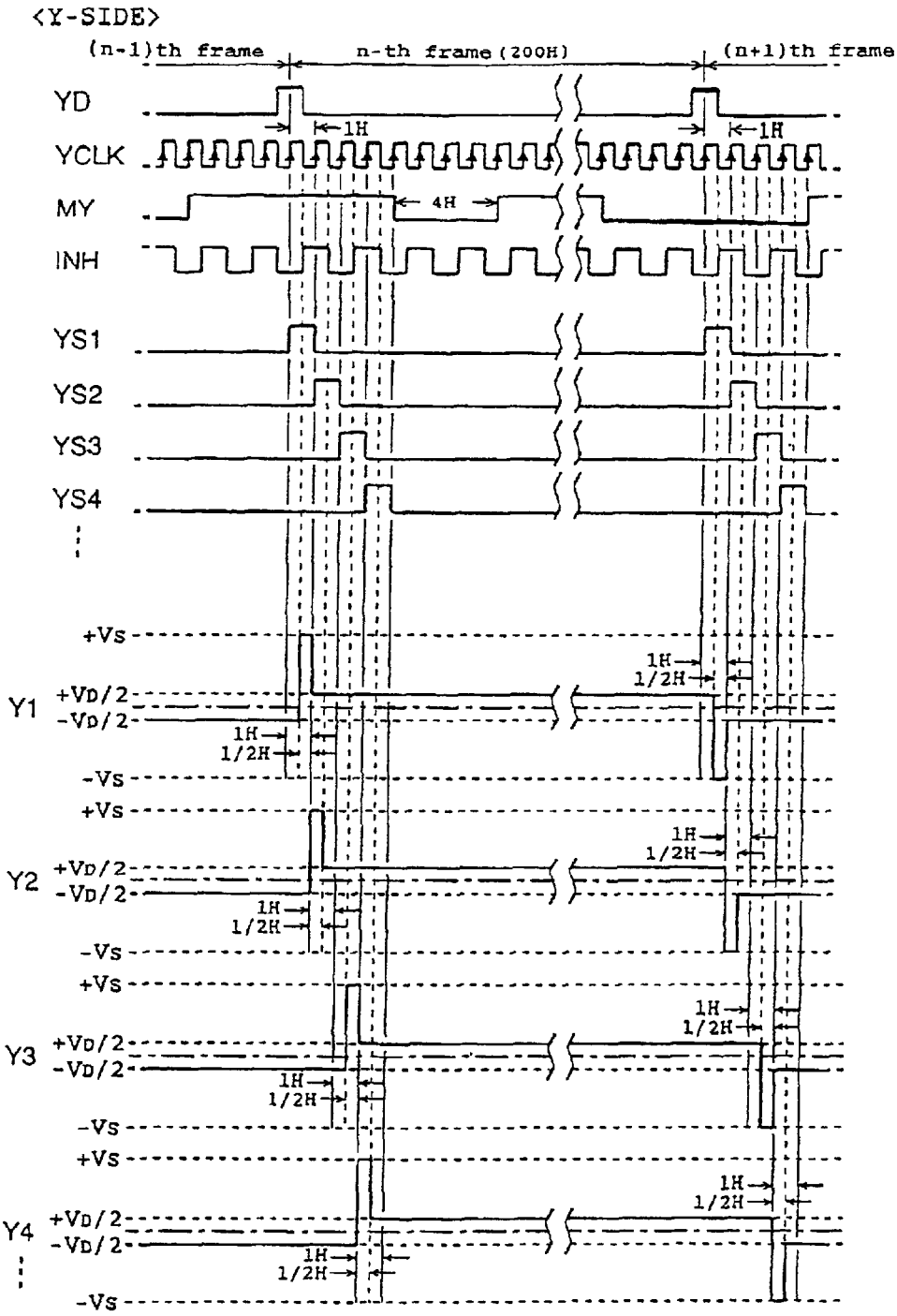
FIG. 12 is a timing chart illustrating the operation of a Y driver in a display device according to a second embodiment of the present invention.

In this embodiment, a control signal INH defining an application time period of the selection voltage in the one horizontal scanning time period 1H has twice the period of a clock signal YCLK, and is set to be at an H-level over the second half time period of the one horizontal scanning time period in which scanning lines 312 on the odd-numbered lines are selected and the first half time period of the one horizontal scanning time period in which subsequent scanning lines 312 on the even-numbered lines are selected, as shown in FIG. 12. For this reason, as regards the scanning lines 312 on the odd-numbered lines, the selection voltage for the scanning signal is applied in the second half time period of the one horizontal scanning time period 1H in which the scanning lines are selected, and as regards the scanning lines 312 on the subsequent even-numbered lines, the selection voltage of the scanning signal is applied in the first half time period of the one horizontal scanning time period 1H.

On the other hand, on the X-side, since the alternate current driving signal MY and the control signal INH are changed, the alternate current signal MX is also changed. That is, while it is common to the first embodiment that when the control signal INH is at an H-level, the logical level of the alternate current driving signal MX is obtained by reversing the level of the alternate current driving signal MY, while, when the control signal INH is at an L-level, the logical level is obtained by maintaining the level of the alternate current driving signal MX, the alternate current driving signal MY and the control signal INH are changed in the second embodiment, as described above, so that the alternate current driving signal MX is changed according thereto.

In addition, in the second embodiment, a latch pulse LPb is supplied to the PWM decoder 2506 in the X driver 250 (see FIG. 8) in place of the latch pulse LPa in the first embodiment. The latch pulse LPb is obtained by removing a latch pulse outputted at the time of changing the logical level of the alternate current driving signal MY from the latch pulse LP for defining the beginning of the one horizontal scanning time period 1H, as shown in FIG. 13.

The PWM decoder 2506 in the second embodiment generates the following voltage selection signal using signals, such as the latch pulse LPb and the like. That is, the PWM decoder 2506 pays attention to one gray scale data Dn, and if the gray scale data designates an intermediate gray scale (gray) display other than the ON display and OFF display, the PWM decoder 2506 generates a voltage selection signal corresponding thereto so that, first, the polarity thereof is reset to be opposite to the polarity represented by the logical level of the alternate current driving signal MX at the rising edge of the latch pulse LPb. Second, at the falling edge of one of the gray scale code pulses GCP corresponding to the gray scale data Dn, the polarity is set to the same polarity as that represented by the logical level of the alternate current driving signal MX, and that the above operations are repeated. Incidentally, it is similar to the first embodiment in that the PWM decoder 2506 generates a voltage selection signal using the reset signal RES and the like so that, if the gray scale data Dn is (00) corresponding to the OFF display, the polarity thereof is set to be opposite to the polarity represented by the logical level of the alternate current driving signal MX, and that, if the gray scale data Dn is (11) corresponding to the ON (black) display, the polarity is set to the same polarity as that represented by the logical level of the alternate current driving signal MX.

Figure 13:
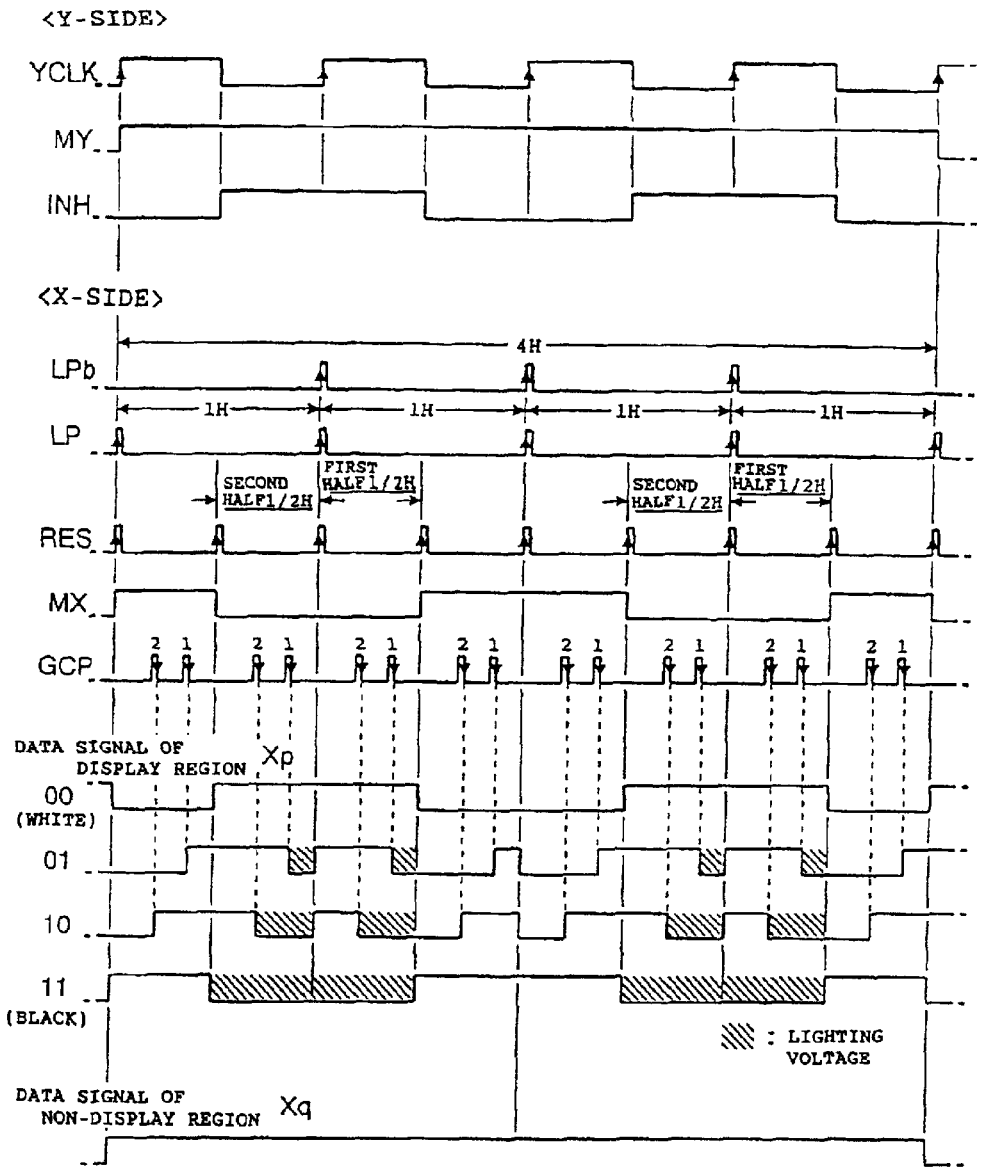
FIG. 13 is a timing chart illustrating the operation of an X driver in the display device.

Eventually, the voltage waveforms of the data signals supplied by the X driver 250 in the second embodiment are as shown in FIG. 13. That is, a lighting voltage is applied in the second half time period and the first half time period in accordance with the fact that the selection voltage of the scanning signal is applied in the second half time period to the scanning lines 312 on the odd-numbered lines, and is applied in the first half time period to the scanning lines 312 on the subsequent even-numbered lines.

Figure 14:
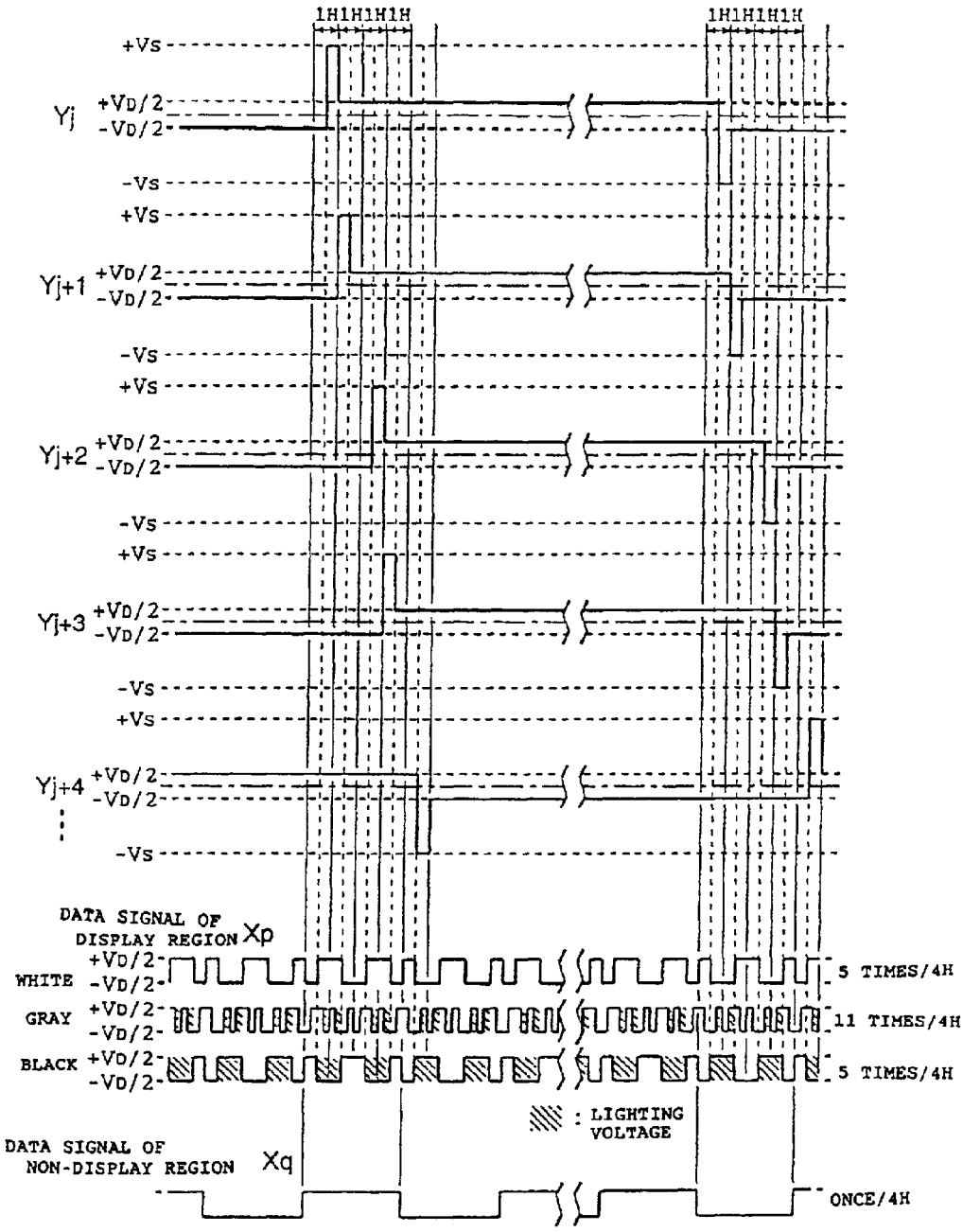
FIG. 14 is a timing chart showing voltage waveforms formed by the X driver and Y driver in connection with gray scale of pixels.

In the second embodiment, the voltage switching frequency of the date signal Xp included in the display region and the voltage switching frequency of the data signal Xp included in the non-display region will be studied with reference to FIG. 14. In this embodiment, the voltage switching frequency of the data signal Xp is, when the OFF (white)-displayed or ON (black)-displayed pixels continue in the column direction, 5 times per 4 horizontal scanning time periods 4H in which the scanning liens having the same polarity of the selection voltage are selected.

In the second embodiment, in general, if the polarity reversal period of the selection voltage is set to m-horizontal scanning time periods, the voltage switching frequency of the data signal Xp to the data lines 212 belonging to the display region is (m+1) times per m-horizontal scanning time periods mH if the OFF (white)-displayed or ON (black)-displayed pixels continue in the column direction, and it is understood that the voltage switching frequency is decreased as compared with the modification of the first embodiment (see FIG. 11). For this reason, in the second embodiment, it is possible to further reduce the power consumption, as compared with the first embodiment.

In the second embodiment, however, while the voltage switching frequency of the data signal Xp to the OFF (white)-displayed or ON (black)-displayed pixels can be decreased as compared with the first embodiment, the voltage switching frequency of the data signal Xp to the gray-displayed pixels is eleven times per four horizontal scanning time periods 4H in this embodiment, and is, in general, when the polarity reversal period of the selection voltage is set to m-horizontal scanning time periods, (3m−1) times per m-horizontal scanning time periods mH, which is rather high as compared with the first embodiment.

However, this can be avoided by employing the following configuration, in addition to a third embodiment, which will be described later. That is, in the partial display as shown in FIG. 5, it is sufficient to display the minimum information in the display region, so that a configuration may be employed in which the gray display is not performed and either the ON display or the OFF display is forcibly performed according to the most significant bit of the gray scale data Dn to inhibit the gray display. When the configuration is employed in which the gray display is inhibited in the partial display, the gray display, which remarkably consumes the power, need not be performed, and not only the voltage switching frequency of the data signal Xq to the non-display region but also the voltage switching frequency of the data signal Xp to the OFF (white)-displayed or ON (black)-displayed pixels in the display region is decreased, so that it is possible to further reduce the power consumption.

Figure 15:
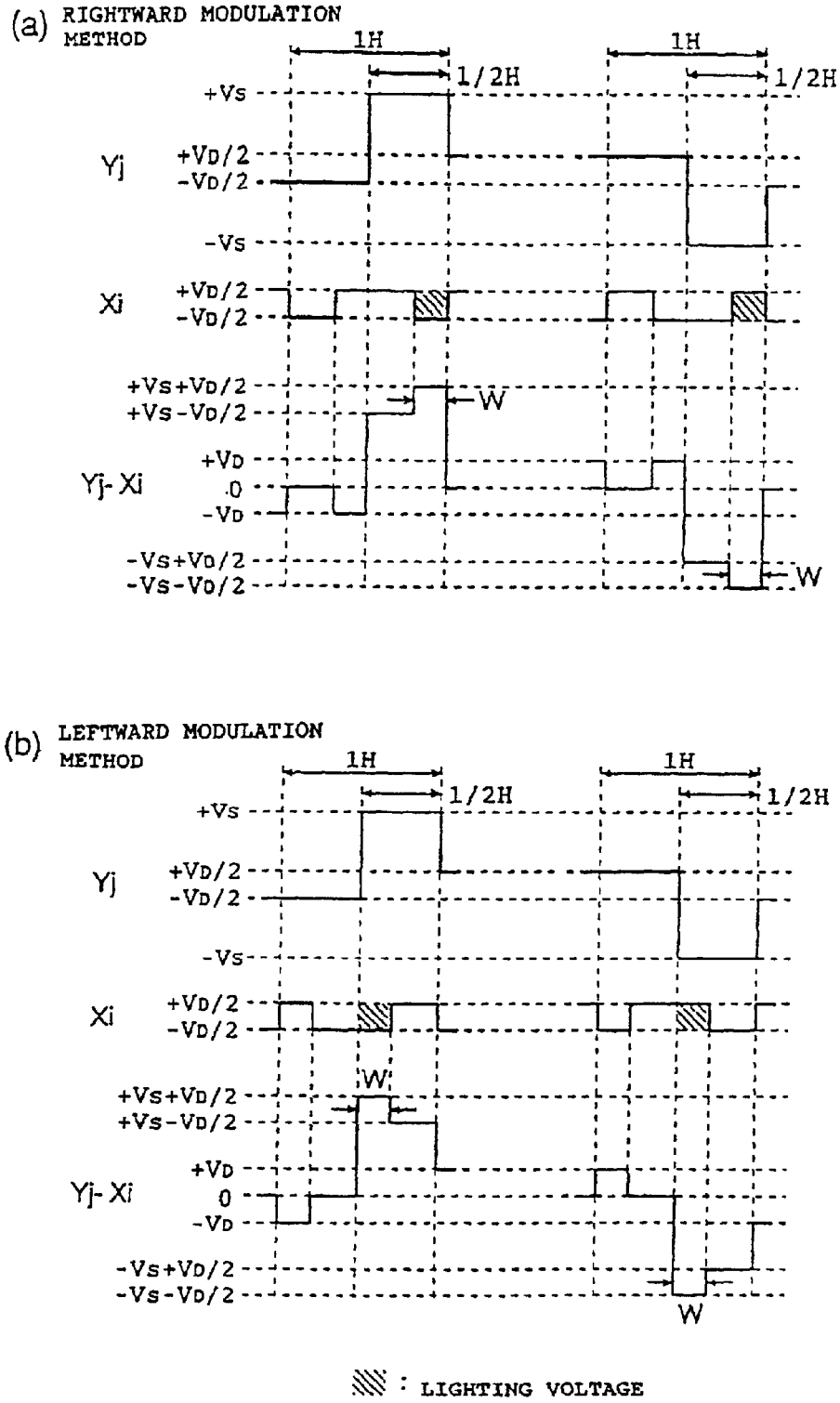
FIG. 15(*a*) is a diagram illustrating a rightward modulation method, and FIG. 15(*b*) is a diagram illustrating a leftward modulation method.

Next, a display device according to a third embodiment of the present invention will be described, but a general driving method when performing a gray scale display will be described before describing the display device. The method for the gray scale display is roughly divided into a voltage modulation and a pulse-width modulation, and a voltage or displaying a predetermined gray scale is difficult to be controlled according to the former voltage modulation, so that the latter pulse-width modulation is generally employed. When the pulse-width modulation is applied to the above-described four-valued driving method (½H select), there are three types of modulation methods: a so-called rightward modulation method, as shown in FIG. 15(*a*), in which a lighting voltage is applied at the end of the selection time period; a so-called leftward modulation method, as shown in FIG. 15(*b*), in which the lighting voltage is applied at the beginning of the selection time period; and a so-called a dispersion modulation method (not shown), in which a lighting voltage of the time width corresponding to the weight of each bit of the gray scale data is dispersed in the selection time period. Here, the lighting voltage means, as described above, one of the data voltages applied to the data lines 212 which has the polarity opposite to that of the selection voltage in the time period in which the selection voltages $\pm V_S$ are applied, and means a voltage which contributes to the wiring of the pixel 116.

Among the three modulation methods, in the leftward modulation method and the dispersion modulation method, since discharge occurs after the lighting voltage is once written, the gray scale is difficult to control, and a drive voltage should be increased, so that, when the gray scale display is performed, the rightward modulation method shown in FIG. 15(*a*) is generally employed in the four-valued driving method.

Here, in the case where the rightward modulation method is employed for the gray scale display in the four-valued driving method, when the pixel 116 in the p-th column included in the display region is OFF (white)-displayed or ON (black)-displayed, the voltage switching frequency of the data signal Xp corresponding to the column is, if the polarity reversal period of the selection voltage is set to m-horizontal scanning time periods mH (m is an integer greater than 2), (2m−1) times per m-horizontal scanning time periods mH in the first and second embodiments, and the voltage scanning time period can be sufficiently brought closer to once per one horizontal scanning time period by increasing the value of m.

When the pixel 116 in a certain column is intermediate gray scale (gray)-displayed, the voltage switching frequency of the data signal Xp corresponding to the column is (3m−1) times, which is rather apt to increase, per m-horizontal scanning time periods mH in the second embodiment, as shown in FIG. 14. For this reason, if the ratio of the gray-displayed pixels in the display region of the partial display is increased, the voltage switching frequency of the data signal Xp increases, and the effect of decreasing the voltage switching frequency of the data signal Xq included in the non-display region is cancelled.

Figure 16:
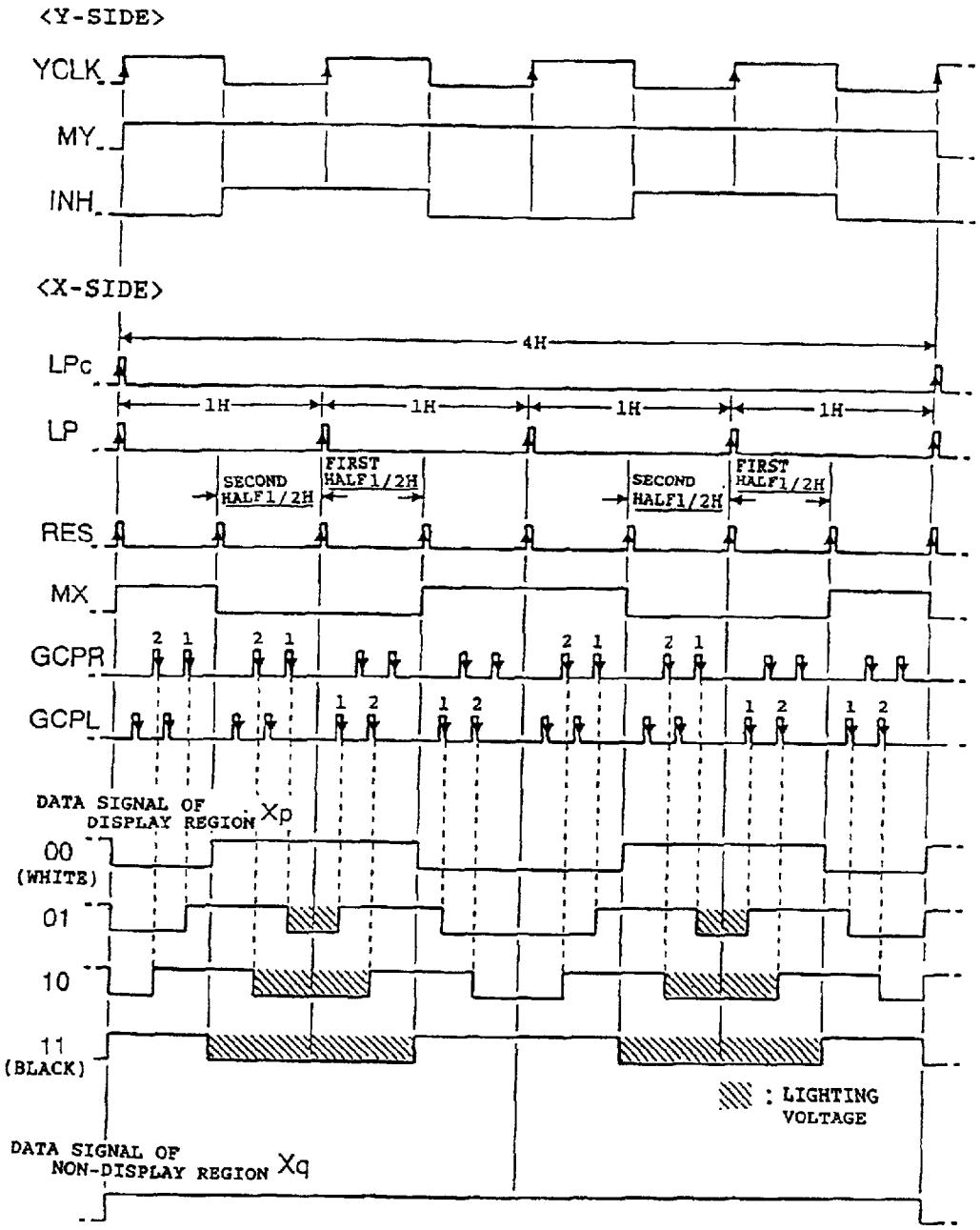
FIG. 16 is a timing chart illustrating the operation of an X driver in a display device according to a third embodiment of the present invention.

Thus, in the display device according to the third embodiment of the present invention, as shown in FIG. 16, the rightward modulation method is employed when the selection voltage is applied in the second half time period ½H of one horizontal scanning time period, while the leftward modulation method is employed when the selection voltage is applied in the first half time period of the one horizontal scanning method, so that the lighting voltage is continuously applied in the second half time period and the first half time period, and the voltage switching frequency of the data signal Xp concerning the gray display is limited to a low level.

While the display device according to the third embodiment will now be described, this display device differs from the display device of the second embodiment only in the control signal on the X-side, and the mechanical and electrical configurations are the same as in the second embodiment. For this reason, as regards the third embodiment, a portion different from that of the second embodiment will be mainly described.

That is, in the same manner as the second embodiment, since the polarity reversal period of the selection voltage is set to four horizontal scanning periods 4H in the third embodiment, the logical level of the alternate current driving signal MY is set so as to be reversed every four horizontal scanning time periods 4H in which four scanning lines 312 are selected such that the 1st line to the 4th line, the 5th line to the 8th line, the 9th line to the 12th line, . . . , the 197th line to the 200th line.

In addition, in the third embodiment, in the same manner as the second embodiment shown in FIG. 12, a control signal INH has twice the period of a clock signal YCLK, and is set to be at an H-level over the second half time period of the one horizontal scanning time period in which scanning lines 312 on the odd-numbered lines are selected and the first half time period of the one horizontal scanning time period in which subsequent scanning lines 312 on the even-numbered lines are selected.

Figure 17:
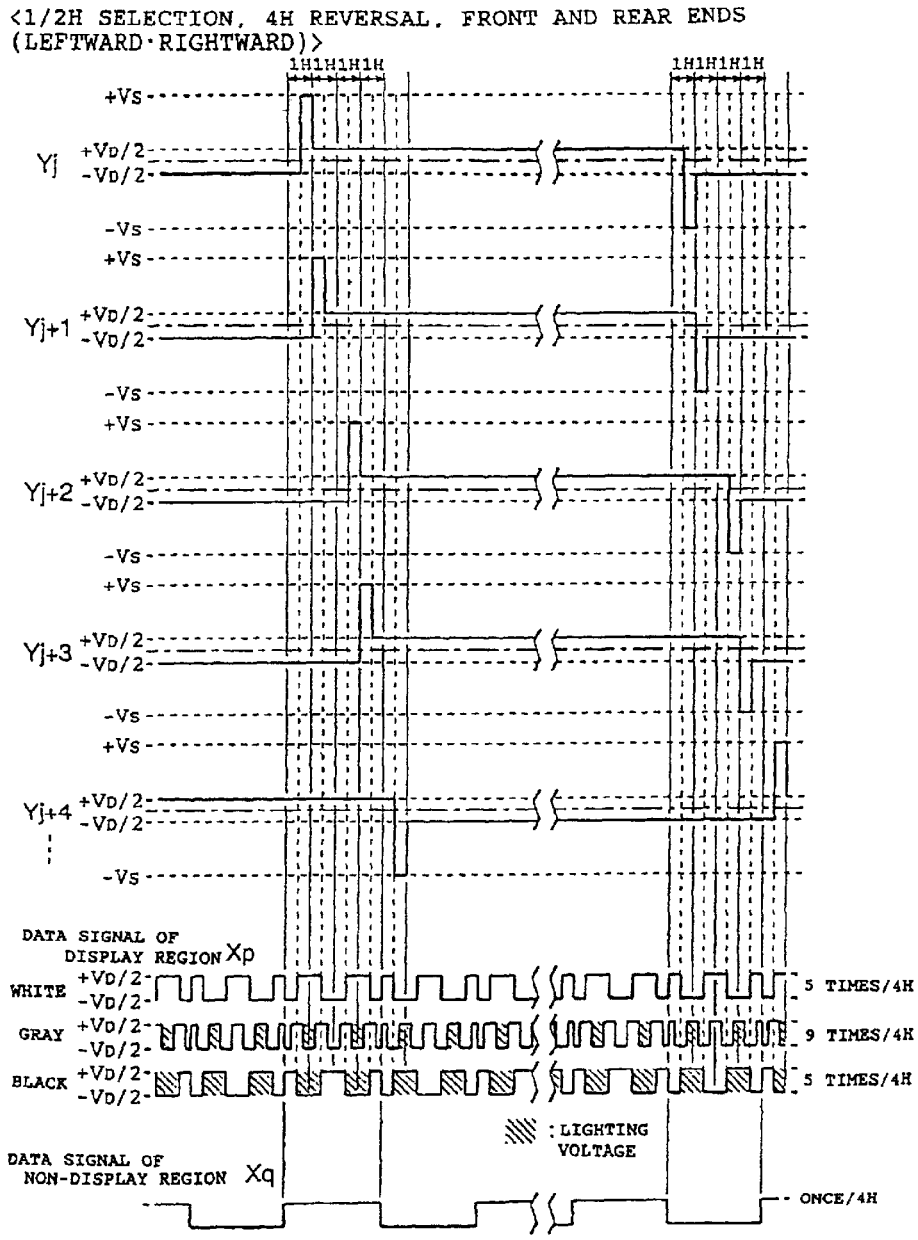
FIG. 17 is a timing chart showing voltage waveforms formed by the X driver and the Y driver in connection with the display mode of pixels.

For this reason, in the third embodiment, as shown in FIG. 17, as regards the scanning lines 312 on the odd-numbered lines, the selection voltage of the scanning signal is applied in the second half time period of the one horizontal scanning time period 1H in which the scanning lines are selected, and as regards the scanning lines 312 on the subsequent even-numbered lines, the selection voltage of the scanning signal is applied in the first half time period of the one horizontal scanning time period 1H. This point is the same as the second embodiment.

On the other hand, the alternate current driving signal MX on the X-side is the same as the second embodiment. That is, it is common to the first embodiment that the logical level of the alternate current driving signal MX is obtained by reversing the level of the alternate current driving signal MY when the control signal INH is at the H-level, while the logical level is obtained by maintaining the level of the alternate current driving signal MY when the control signal INH is at the L-level, but since the alternate current driving signal MY and the control signal INH are changed in the third embodiment as described above, the alternate current driving signal MX is changed according thereto.

In the third embodiment, however, a latch pulse LPc is supplied in place of the latch pulse LPb in the second embodiment and further, a gray scale code pulse GCPR for rightward modulation and a gray scale code pulse GCPL for leftward modulation are supplied in place of the gray scale code pulse GCP to the PWM decoder 2506 (see FIG. 8) in the X driver 250. Among these pulses, the latch pulse LPc is obtained by extracting a latch pulse outputted at the time of changing the logical level of the alternate current driving signal MY from the latch pulse LP for defining a start of the one horizontal scanning time period 1H, as shown in FIG. 16. Further, the gray scale code pulse for rightward modulation GCPR is a gray scale controlling pulse used in the rightward modulation method arranged at the position of the time period on the proximal side from each of the end points of the first half time period and the second half time period, into which the one horizontal scanning time period 1H is divided, according to the level of the intermediate gray scale, as shown in FIG. 16, and is the same as the gray scale code pulse GCP in the first and second embodiments. On the other hand, the gray scale code pulse GCPL for leftward modulation is a gray scale controlling pulse used in the leftward modulation method, and is arranged at the position of the time period corresponding to level of the intermediate gray scale from each of the starting points of the first half time period and the second half time period of the one horizontal scanning time period 1H, as shown in FIG. 16.

And, a PWM decoder 2506 in the third embodiment generates the following voltage selection signal using the signals, such as the latch pulse LPc, the gray scale code pulse GCPR for the rightward modulation, and the gray scale code pulse GCPL for the leftward modulation. That is, the PWM decoder 2506, first, when the latch pulse LP supplied simultaneously with the latch pulse LPc is assumed to be the first latch pulse, recognizes a time period during which the second latch pulse LP is supplied after the 1st latch pulse LP is supplied, and a time period during which the fourth latch pulse LP is supplied after the third latch pulse LP is supplied as one horizontal scanning time period, respectively, in which a selection voltage should be supplied in the second half time period, while the PWM decoder 2506 recognizes a time period during which the third latch pulse LP is supplied after the second latch pulse LP is supplied, and a time period during which the next latch pulse LP is supplied after the fourth latch pulse LP is supplied as one horizontal scanning time period, respectively, in which the selection voltage should be supplied in the first half time period.

Then, the PWM decoder 2506, when the one horizontal scanning time period is recognized in which the selection voltage should be supplied in the second half time period, pays attention to one gray scale data Dn, and if the gray scale data designates an intermediate gray scale (gray) display other than the ON display and the OFF display, generates a voltage selection signal corresponding thereto so that, second, the polarity of the signal is reset to the same polarity as that represented by an immediately preceding logical level of an alternate current driving signal MX at the rising edge of the latch pulse LP, third, the polarity of the signal is set to the same polarity as that represented by the logical level of the alternate current driving signal MX at the falling edge of one of the gray scale code pulses GCPR for the rightward modulation in the first half time period corresponding to the gray scale data Dn, and fourth, the polarity of the signal is set again to the same polarity as that represented by the logical level of the alternate current driving signal MX at the falling edge of one of the gray scale code pulses GCPL for the leftward modulation in the second half time period corresponding to the gray scale data Dn.

On the other hand, the PWM decoder 2506, when the one horizontal scanning time period is recognized in which the selection voltage should be supplied in the first half time period, pays attention to one gray scale data Dn, and if the gray scale data designates the intermediate gray scale (gray) display other than the ON display and the OFF display, generates a voltage selection signal corresponding thereto so that, second, the polarity of the signal is reset to the same polarity as that represented by the logical level of the alternate current driving signal MX at the rising edge of the latch pulse LP, third, the polarity of the signal is set to be opposite to the polarity represented by the logical level of the alternate current driving signal MX at the falling edge of one of the gray scale code pulses GCPL for leftward modulation in the first half time period corresponding to the gray scale data Dn, and fourth, the polarity of the signal is set again to be opposite to the polarity represented by the logical level of the alternate current driving signal MX at the falling edge of one of the gray scale code pulses GCPR for rightward modulation in the second half time period corresponding to the gray scale data Dn.

Incidentally, it is similar to the first embodiment in that, even in the one horizontal scanning time period in which the selection voltage should be supplied in the first half time period or the second half time period, the PWM decoder 2506 generates the voltage selection signal using the reset signal RES and the like so that, if the gray scale data Dn is (00) corresponding to the OFF (white) display, the polarity of the signal is opposite to the polarity represented by the logical level of the alternate current driving signal MX, and that, if the gray scale data Dn is (11) corresponding to the ON (black) display, the signal has the polarity represented by the logical level of the alternate current driving signal MX.

Eventually, the voltage waveforms of the date signal supplied to the X driver 250 in the third embodiment are as shown in FIG. 16. That is, when the selection voltage is applied to a certain scanning line 312 in the second half time period, the lighting voltage is applied by the rightward modulation method, and when the selection voltage is applied to a subsequent scanning line 312 in the first half time period, the lighting voltage is applied by the leftward modulation method, so that the lighting voltage is applied continuously in the second half time period and the first half time period.

Here, in the third embodiment, when the voltage switching frequency of the data signal Xp to the gray-displayed pixel included in the display region is studied, the frequency is nine times per four horizontal scanning time periods 4H, and in general, in the case where the polarity reversal period of the selection voltage is set to m-horizontal scanning time periods, the frequency is (2m+1) times per m-horizontal scanning time periods mH, which is the same as the first embodiment.

Incidentally, in the third embodiment, if the OFF (white)-displayed or ON (black)-displayed pixels continue in the column direction, in the same manner as the second embodiment, the voltage switching frequency of the data signal Xp is five times per the four horizontal scanning time periods 4H in which the scanning liens having the same polarity of the selection voltage are selected, and in general, when the polarity reversal period of the selection voltage is set to m-horizontal scanning time periods, the voltage switching frequency of the data signal Xp to the data lines 212 belonging to the display region is (m+1) times per m-horizontal scanning time periods mH.

For this reason, in the third embodiment, the voltage switching frequency of the data signal Xp to the OFF (white)-displayed or ON (black)-displayed pixels included in the display region can be limited to the same level as the second embodiment and further, the voltage switching frequency of the data signal Xp to the gray-displayed pixels can be limited to the same level as the first embodiment.

According to the above-described first, second, and third embodiments, when the longitudinally elongated partial display as shown in FIG. 5 is performed, as compared with a configuration in which the data signal Xq to the data lines included in the non-display region is simply the OFF-displayed signal, the voltage switching frequency is decreased, so that the power consumption is reduced.

Incidentally, in the above-described second and third embodiments, since the second half time period ½H in the one horizontal scanning time period and the first half time period ½H in the next one horizontal scanning time period are paired, m representing the polarity reversal period of the selection voltage tends to be regarded as an even number greater than two, but m may be an odd number. When m is an odd number, unpaired horizontal scanning time periods are generated, but they do not affect the voltage switching frequency of the data signals Xp and Xq.

In addition, while the data PDx for specifying the data line 212 presenting the non-display is supplied to the PWM decoder 2506 in the above-described embodiments, a configuration may be adopted in which the data PDx is supplied to the address control circuit 2502 so as to inhibit the generation of the read address Rad of the gray scale data Dn corresponding to the data, and whereby, the PWM decoder 2506 recognizes that the data lines from which the gray scale data Dn is not read should present non-display, and generates the voltage selection signal of the data signal Xq.

Further, while the transmissive display device is described in the above embodiments, a reflective or a transflective display device may also be employed. When the reflective display device is employed, the pixel electrodes 234 may be formed of a reflective metal, such as aluminum, or a reflective film may be separately formed so that light from the counter substrate 300 is reflected. In addition, when the transflective display device is employed, the pixel electrode 234 formed of reflective metal or the reflective film may be formed very thin, or an opening may be provided, and when the reflective display device is employed, light from the counter substrate 300 is reflected, while illuminating light generated by the backlight may be transmitted when the transmissive display device is employed.

In addition, while the four-gray scale display presented by the 2-bit gray scale data Dn is performed in the above-described embodiments, the present invention is not limited thereto, and a multi-gray scale display presented by three bits or more may be performed. And, of course, the pixels may be allowed to correspond to red (R), green (G), and blue (B) so as to perform color display.

On the other hand, in FIG. 1, while the TFD 220 is connected to the side of the data line 212 and the liquid crystal layer 118 is connected to the side of the scanning line 312, contrary to this, the TFD 220 may be connected to the side of the scanning line 312, and the liquid crystal layer 118 may be connected to the side of the data line 212.

In addition, the TFD 220 in the above-described liquid crystal panel 100 is an example of switching device, and a device using ZnO (zinc oxide) variable resistor or an MSI (Metal Semi-Insulator), and a tow-terminal device can be applied in which two devices are connected in series or in parallel in the opposite direction and further, a three-terminal device can be applied, such as an insulating gate field effect transistor.

However, in the case where the three-terminal device is applied to the switching device, both the data lines 212 and the scanning lines 312 should be formed on the device substrate 200 in such a manner as to intersect with one another, instead of forming only the data lines or only the scanning lines 312 thereon. Such an application is disadvantageous in that the likelihood of occurrence of a short circuit in the wiring is enhanced, and that the manufacturing process is complicated because the configuration of a TFT itself is more complicated than that of a TFD. In addition, the display device of the present invention is applicable to a passive-type liquid crystal, which does not employ a switching device, such as a TFD or a TFT.

Further, while the TN type liquid crystal is employed in the above-described embodiments, liquid crystal of a bi-stable type having memory, such as a BTN (Bi-stable Twisted Nematic) type/ferroelectric type, a polymer dispersed type and further, a GH (guest-host) type in which a dye (guest) having anisotropy in the absorption of visible light in the major axis and the minor axis of molecules is dissolved in a liquid crystal (host) having a fixed molecular arrangement, and the dye molecules and the liquid-crystal molecules are arranged in parallel, may be employed. In addition, perpendicular orientation (homeotropic orientation) may be adopted in which the liquid-crystal molecules are perpendicularly arranged with respect to the two substrates when no voltage is applied, while the liquid-crystal modulates are arranged in parallel to the two substrates with a voltage applied, and parallel (horizontal) orientation (homogeneous orientation) may be adopted in which the liquid-crystal molecules are arranged in parallel to the two substrates when no voltage is applied, while the molecules are perpendicularly arranged to the two substrates when a voltage is applied. In this way, according to the present invention, various liquid crystals and various orientation methods can be employed without departing from the spirit and scope of the present invention.

Additionally, while the display device using liquid crystal as the electro-optical material has been described by way of example in the above description, the present invention is applicable to a display device for performing a display by utilizing the electro-optical effect, such as an electroluminescent device, a fluorescent display tube, and a plasma display. That is, the present invention is applicable to all display devices each having a configuration similar to that of the above-described display device.

Next, an example using the display device according to the above-described embodiments in an electronic apparatus will be described.

Figure 23:
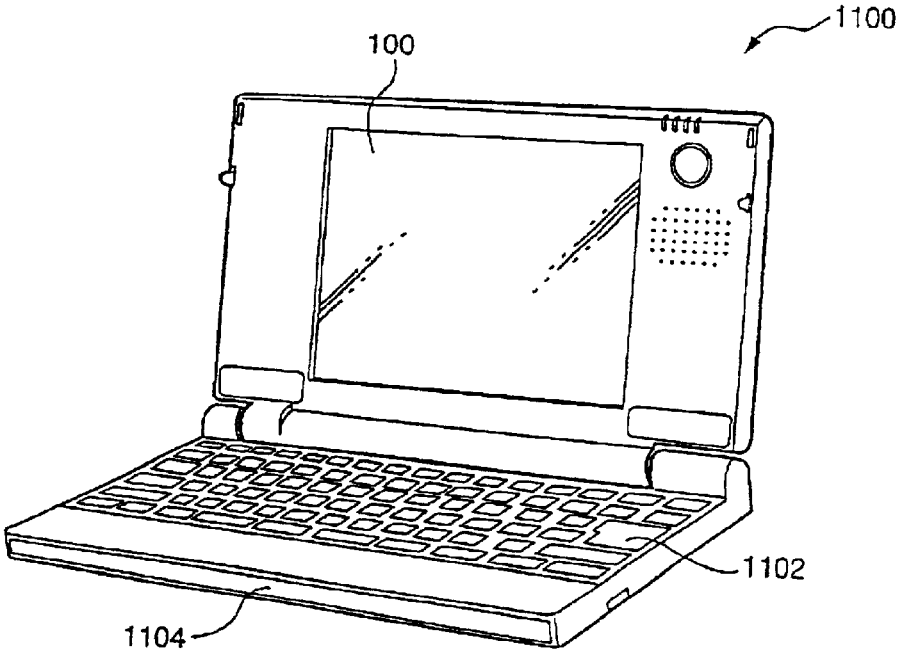
FIG. 23 is a perspective view showing the configuration of a personal computer that is an example of the electronic apparatus to which the display device according to the embodiments is applied.

First, a description will be given of an example applying the above-described display device to a display portion of a mobile personal computer. FIG. 23 is a perspective view showing the configuration of this personal computer. In the figure, a computer 1100 includes a main body portion 1104 provided with a keyboard 1102, and a liquid crystal panel 100 used as a display portion. Incidentally, although a backlight is provided on the back face of the liquid crystal panel 100 to improve visibility, the backlight is omitted in the figure because it is not seen outwardly.

Figure 24:
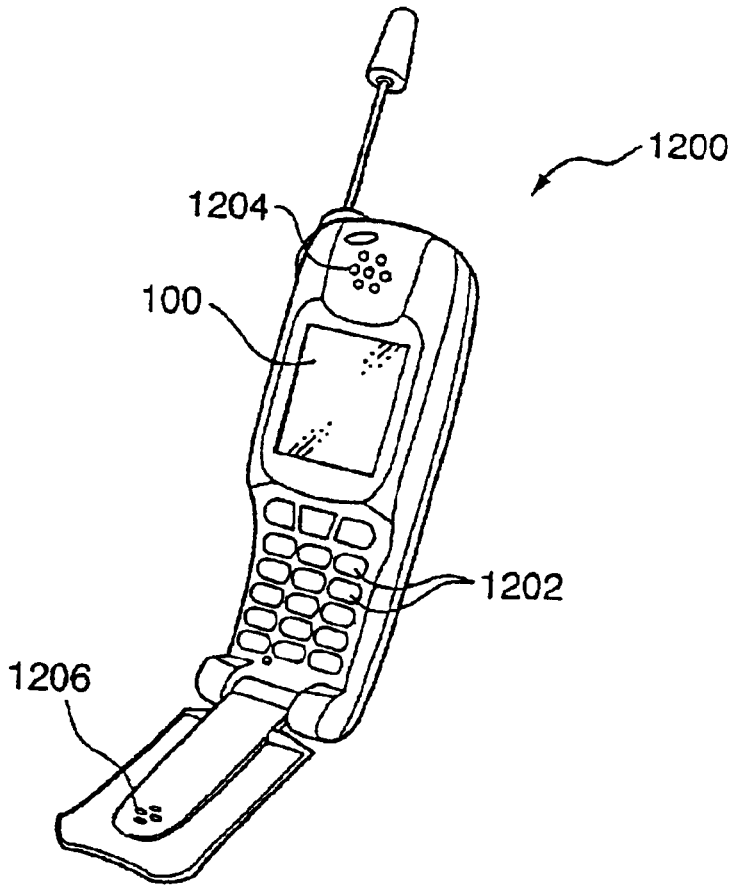
FIG. 24 is a perspective view showing the configuration of a portable telephone that is an example of the electronic apparatus to which the display device is applied.

Subsequently, a description will be given of an example applying the above-described display device to a display portion of a portable telephone. FIG. 24 is a perspective view showing the configuration of this portable telephone. In the figure, a portable telephone 1200 includes the above-described liquid crystal panel 100, in addition to a plurality of operating buttons 1202, an earpiece 1204, and a mouthpiece 1206. This liquid crystal panel 100 performs a full-screen display using all regions as display regions at the time of reception or transmission, while the liquid crystal panel 100 performs partial display at the time of waiting for incoming calls, and displays only necessary information, such as electric field strength, numbers, characters, and date and time, on the display region. This suppresses the power consumed in the display device during waiting for incoming calls, so that it is possible to increase the length of a time period, during which the telephone can wait for incoming calls, to a long time period. Incidentally, while a backlight for improving visibility is also provided on the back face of this liquid crystal panel 100, the backlight is omitted in the figure because it is not seen outwardly.

Figure 25:
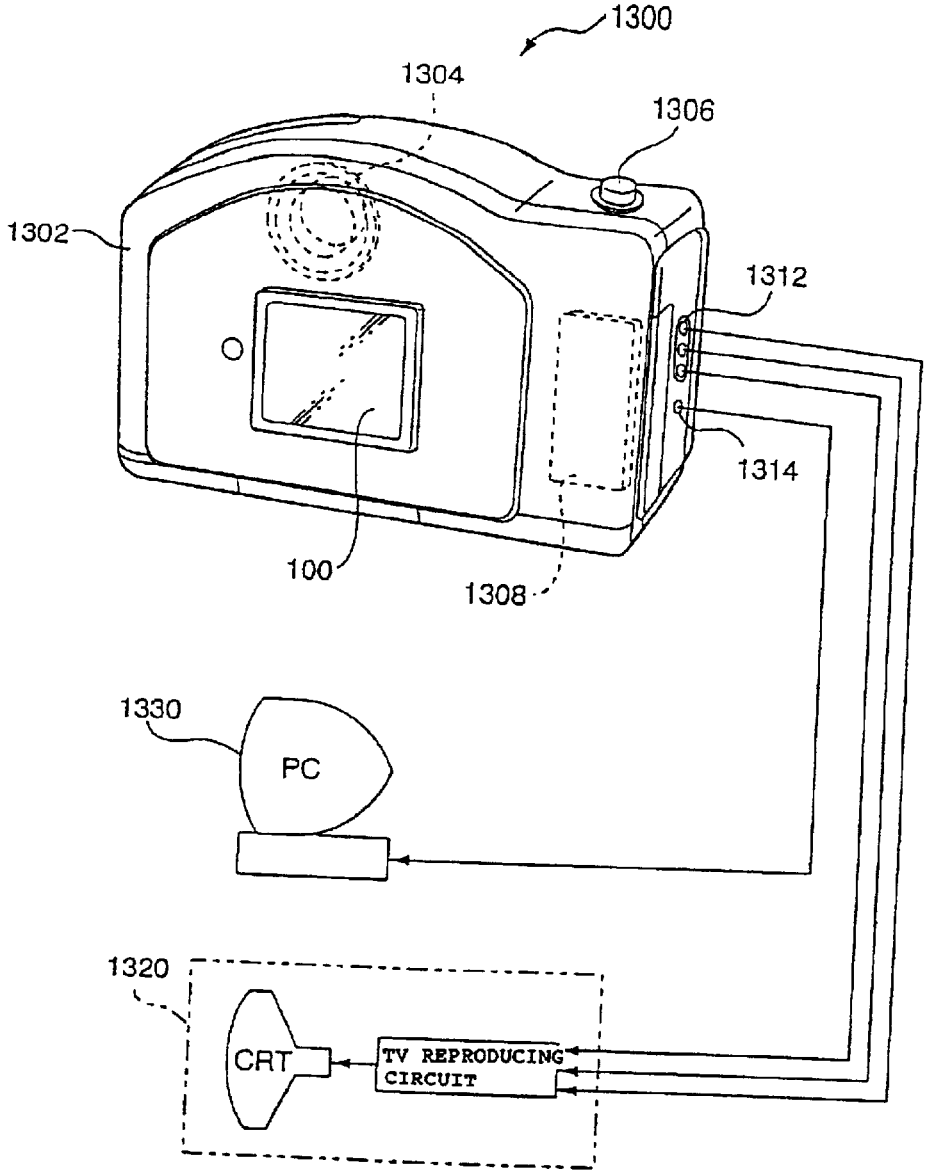
FIG. 25 is a perspective view showing the configuration of a digital still camera that is an example of the electronic apparatus to which the display device is applied.
Figure 26:
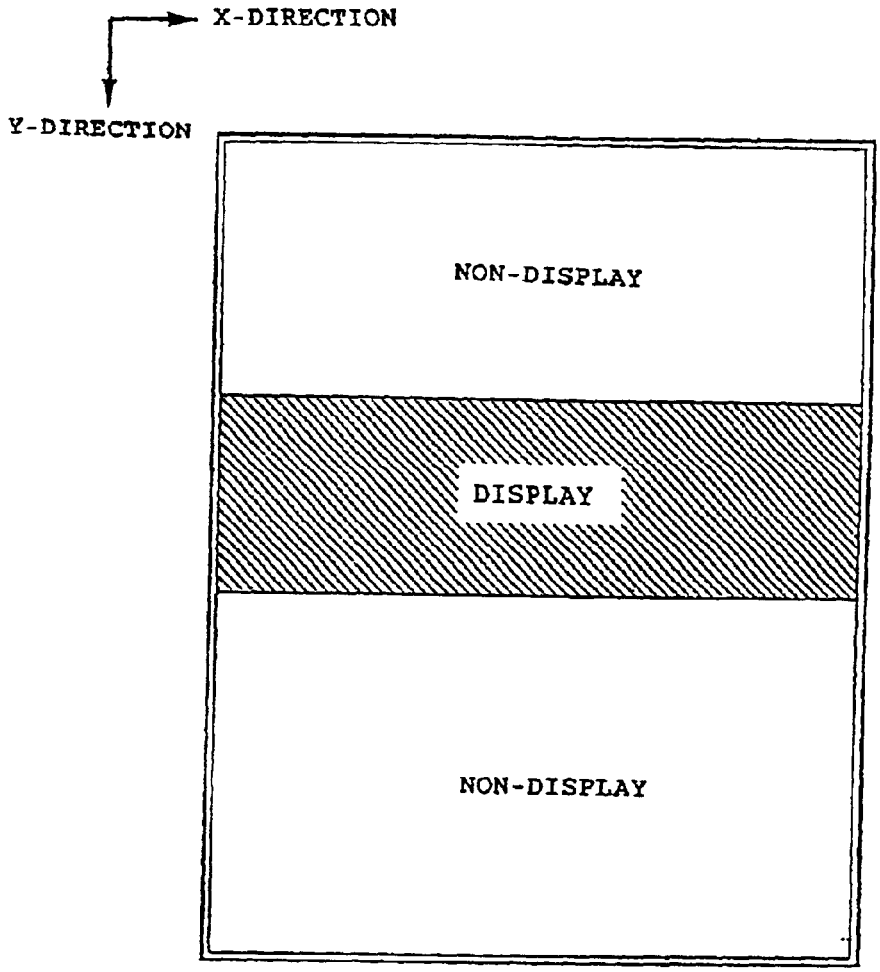
FIG. 26 is an exemplary diagram illustrating the display modes performed by a conventional partial display driving.

Next, a digital still camera using the above-described display device in a viewfinder will be described. FIG. 25 is a perspective view showing the configuration of this digital still camera, but the figure also shows simply an interfacing to external apparatuses.

A normal silver salt camera exposes a film to the light by an optical image of an object, whereas a digital still camera 1300 subjects the optical image of the object to an photoelectric conversion by an image pickup device, such as a CCD (Charge Coupled Device), to generate an image pickup signal. Here, the above-described liquid crystal panel 100 is provided on the back face of a case 1302 of the digital still camera 1300, and a display is performed on the basis of the image pickup signals generated by the CCD. For this reason, the liquid crystal panel 100 functions as a viewfinder for displaying the object. In addition, a light-receiving unit 1304 including an optical lens, the CCD, and the like is provided on the side of a front surface (on the rear face in FIG. 25) of the case 1302.

Here, when a photographer confirms an object image displayed on the liquid crystal panel 100, and presses down a shutter button 1306, image pickup signals of the CCD at that time are transferred to and stored in a memory of a circuit board 1308. In addition, in this digital still camera 1300, a video signal output terminal 1312 and a data communicating input/output terminal 1314 are provided on a side surface of the case 1302. And, as shown in the figure, a television monitor 1320 is connected to the former video signal output terminal 1312, and a personal computer 1330 is connected to the latter data communication input/output terminal 1314 according to demand. Further, the image pickup signals stored in the memory of the circuit board 1308 are outputted to the television monitor 1320 and the personal computer 1330 by a predetermined operation.

Incidentally, in addition to the personal computer shown in FIG. 23, the portable telephone shown in FIG. 24, and the digital still camera shown in FIG. 25, a liquid crystal television set, a viewfinder-type or monitor direct view-type video tape recorder, a car navigation system, a pager, an electronic notepad, an electric calculator, a word processor, a workstation, a television telephone, a POS terminal, and an apparatus having a touch panel are cited as examples of the electronic apparatus. And, it is needless to say that the above-described display device is applicable to a display portion of the various types of the electronic apparatuses.

As described above, according to the present invention, when a pixel belonging to a specific data line is put into a display state and pixels belonging to other data lines are put into a non-display state, a switching frequency of a voltage is decreased, as compared with a case where a non-selection voltage is simply applied to the data lines other than the specific data line, so that the power consumed in accordance with the switching of the voltage can be limited to a low level.

While this invention has been described in conjunction with specific embodiments thereof, it is evident that many alternatives, modifications, and variations will be apparent to those skilled in the art. Accordingly, preferred embodiments of the invention as set forth herein are intended to be illustrative not limiting. Various changes may be made without departing from the spirit and scope of the invention.

What is claimed is:

1. A method for driving a display device driving a pixel provided corresponding to each of intersections between a plurality of scanning lines and a plurality of data lines, wherein:

one scanning line in said plurality of scanning lines is selected every one horizontal scanning time period, and a selection voltage is applied to the selected scanning line in one of time periods into which the one horizontal scanning time period is divided;

the polarity of said selection voltage is reversed at least every two or more horizontal scanning time periods on the basis of an intermediate value of an ON voltage and an OFF voltage applied to said data lines; and when a pixel belonging to a specific data line in said plurality of data lines is put into a display state, and pixels belonging to other data lines are put into a non-display state, an ON voltage is applied to said specific data line in one horizontal scanning time period, in which one scanning line in said plurality of scanning lines is selected and a selection voltage is applied to the selected scanning line according to the contents to be displayed by a pixel corresponding to an intersection between the selected scanning line and the specific data line, and an ON voltage and an OFF voltage are applied to said specific data line for substantially the same period over one horizontal scanning time period in which the selected scanning line is selected, while an OFF voltage is supplied to data lines other than said specific data line according to the polarity of the selection voltage applied to the selected scanning line, and by reversing the polarity every polarity reversal period of said selection voltage;

when a scanning line is selected, a selection voltage is applied to the selected scanning line in the second half time period of one of time periods, into which one horizontal scanning time period is divided;

when the next one scanning line is selected, a selection voltage is applied to the selected scanning line in the first half time period of one of time periods, into which one horizontal scanning time period is divided; and the selection voltage is alternately applied in one time period and in the other time period every one horizontal scanning time period.

2. The method for driving a display device as claimed in claim 1, wherein:

when said selection voltage is applied in said second half time period, an ON voltage is applied to said specific data line from a point of time before an end point of the second half time by a time period according to the gray scale of a pixel corresponding to an intersection between the selected scanning line and the specific data line to the end point of the second half time period, and an OFF voltage is applied in the remaining time period of the second half time period; and while, when said selection voltage is applied in said first half time period, an ON voltage is applied to said specific data line from a starting point of the first half time period to a time period according to the gray scale of a pixel corresponding to an intersection between the selected scanning line and the specific data line, and an OFF voltage is applied in the remaining time period of the first half time period.

3. A driving circuit for a display device driving a pixel provided corresponding to each of intersections between a plurality of scanning lines and a plurality of data lines, the driving circuit comprising:

a scanning line driving circuit that selects one scanning line in said plurality of scanning lines every one horizontal scanning time period, applies a selection voltage to the selected scanning line in one of time periods, into which the one horizontal scanning time period is divided, and reverses the polarity of said selection voltage at least every two or more horizontal scanning time periods on the basis of an intermediate value of an ON voltage and an OFF voltage applied to said data lines; and a data line driving circuit that applies, when a pixel belonging to a specific data line in said plurality of data lines is put into a display state, and pixels belonging to other data lines are put into a non-display state, an ON voltage to said specific data line in one horizontal scanning time period, in which one scanning line in said plurality of scanning lines is selected and a selection voltage is applied to the selected scanning line according to the contents to be displayed by a pixel corresponding to an intersection between the selected scanning line and the specific data line, and applies an ON voltage and an OFF voltage to said specific data line for substantially the same period over one horizontal scanning time period, in which the selected scanning line is selected, while supplying an OFF voltage to data lines other than said specific data line according to the polarity of the selection voltage applied to the selected scanning line, and by reversing the polarity every polarity reversal period of said selection voltage;

said scanning line driving circuit applies a selection voltage to the selected scanning line in the second half time period of one of time periods, into which one horizontal scanning time period is divided, when a scanning line is selected; applies a selection voltage to the selected scanning line in the first half time period of one of time periods, into which one horizontal scanning time period is divided, when the next one scanning line is selected; and applies the selection voltage alternately in one time period, and in the other time period every one horizontal scanning time period.

4. The driving circuit for a display device as claimed in claim 3, wherein, when said selection voltage is applied in said second half time period by said scanning line driving circuit, said data line driving circuit applies an ON voltage to said specific data line from a point of time before an end point of the second half time by a time period according to the gray scale of a pixel corresponding to an intersection between the selected scanning line and the specific data line to the end point of the second half time period, and applies an OFF voltage in the remaining time period of the second half time period; while, when said selection voltage is applied in said first half time period by said scanning line driving circuit, said data line driving circuit applies an ON voltage to said specific data line from a starting point of the first half time period to a time period according to the gray scale of a pixel corresponding to an intersection between the selected scanning line and the specific data line, and applies an OFF voltage in the remaining time period of the first half time period.

5. A display device having a pixel provided corresponding to each of intersections between a plurality of scanning lines and a plurality of data lines, said display device comprising:

a scanning line driving circuit that selects one scanning line in said plurality of scanning lines every one horizontal scanning time period, applies a selection voltage to the selected scanning line in one of time periods into which the one horizontal scanning time period is divided, and reverses the polarity of said selection voltage at least every two or more horizontal scanning time periods on the basis of an intermediate value of an ON voltage and an OFF voltage applied to said data lines; and a data line driving circuit that applies, when a pixel belonging to a specific data line in said plurality of data lines is put into a display state, and pixels belonging to other data lines are put into an ON voltage to said specific data line in one horizontal scanning time period, in which one scanning line in said plurality of scanning lines is selected and a selection voltage is applied to the selected scanning line, according to the contents to be displayed by a pixel corresponding to an intersection between the selected scanning line and the specific data line, and applies an ON voltage and an OFF voltage to said specific data line for substantially the same period over one horizontal scanning time period, in which the selected scanning line is selected, while supplying an OFF voltage to data lines other than said specific data line according to the polarity of the selection voltage applied to the selected scanning line, and by reversing the polarity every polarity reversal period of said selection voltage;

said scanning line driving circuit applies a selection voltage to the selected scanning line in the second half time period of one of time periods, into which one horizontal scanning time period is divided, when a scanning line is selected; applies a selection voltage to the selected scanning line in the first half time period of one of time periods, into which one horizontal scanning time period is divided, when the next one scanning line is selected; and applies the selection voltage alternately in one time period and in the other time period every one horizontal scanning time period.

6. The display device as claimed in claim 5, wherein said pixel includes a capacitive device including a switching device and an electro-optical material, and when a selection voltage is applied to one scanning line, a switching device of the pixel belonging to the scanning line is put into a conductive state, and writing operation according to an ON voltage applied to the corresponding data line is performed on the capacitive device corresponding to the switching device.

7. The display device as claimed in claim 6, wherein said switching device is a two-terminal switching device, and said pixel is constructed by series-connecting said two-terminal switching device and said capacitive device between a scanning line and a dateline.

8. The display device as claimed in claim 7, wherein said two-terminal switching device has a conductor/insulator/conductor structure connected to at least one of said scanning line and said data line.

9. An electronic apparatus comprising the display device as claimed in claim 5.

* * * * *